US007458362B2

(12) United States Patent
Hazama et al.

(10) Patent No.: US 7,458,362 B2
(45) Date of Patent: Dec. 2, 2008

(54) FUEL SUPPLY SYSTEM FOR INTERNAL COMBUSTION ENGINE

(75) Inventors: Tadashi Hazama, Chita-gun (JP); Toshihiko Muramatsu, Chiryu (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/724,244

(22) Filed: Mar. 15, 2007

(65) Prior Publication Data

US 2007/0227511 A1 Oct. 4, 2007

(30) Foreign Application Priority Data

Mar. 29, 2006 (JP) ..... 2006-090837
Apr. 4, 2006 (JP) ..... 2006-102811

(51) Int. Cl.
*F02M 37/00* (2006.01)
*F02M 69/54* (2006.01)

(52) U.S. Cl. ..... 123/457; 123/511; 123/514

(58) Field of Classification Search ..... 123/457–465, 123/510, 511, 514; 137/86, 100, 115.01, 137/115.13, 505.14, 505.15, 505.16, 505.22, 137/505.37
See application file for complete search history.

(56) References Cited

U.S. PATENT DOCUMENTS 4,300,509 A * 11/1981 Schechter ..... 123/499
5,359,976 A 11/1994 Nakashima et al.
5,425,342 A * 6/1995 Ariga et al. ..... 123/456
5,471,962 A 12/1995 Nakashima et al.
5,577,482 A 11/1996 Nakashima et al.
5,706,785 A * 1/1998 Radermacher et al. ..... 123/457
5,794,597 A * 8/1998 Schwegler et al. ..... 123/514
5,967,119 A * 10/1999 Burkhard et al. ..... 123/458
6,601,565 B2 * 8/2003 Tofan-Petre ..... 123/457

FOREIGN PATENT DOCUMENTS

JP 05-039763 2/1993
JP 05-321783 12/1993
JP 2002-310025 10/2002

* cited by examiner

*Primary Examiner*—Thomas N Moulis
(74) *Attorney, Agent, or Firm*—Nixon & Vanderhye PC

(57) ABSTRACT

In a fuel supply system, a fuel pump supplies fuel from a fuel tank to a fuel supply piping and to a back pressure introducing passage. A pressure regulator has a fuel pressure regulating chamber communicated to the fuel supply piping, and a back pressure chamber communicated to the back pressure introducing passage. When a fuel pressure in the fuel pressure regulating chamber is larger than a relief pressure that bulges the diaphragm toward the back pressure chamber, a relief valve opens a relief port to return the fuel from the fuel pressure regulating chamber to the fuel tank. The relief pressure is adjusted by controlling a fuel pressure in the back pressure chamber of the pressure regulator.

13 Claims, 13 Drawing Sheets

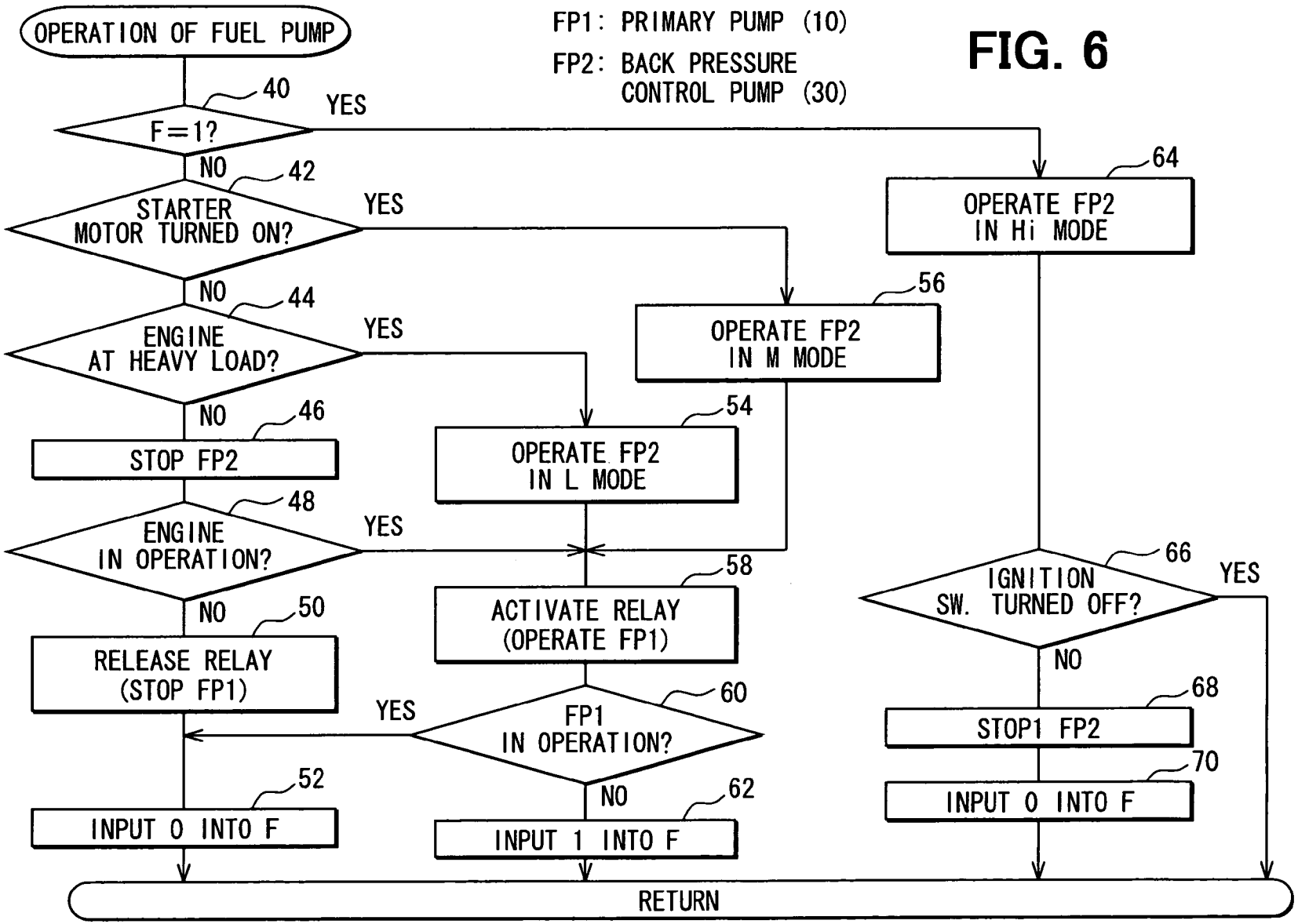
FIG. 6
FP1: PRIMARY PUMP (10)
FP2: BACK PRESSURE CONTROL PUMP (30)
OPERATION OF FUEL PUMP
40
F=1?
YES
NO
42
STARTER MOTOR TURNED ON?
YES
NO
44
ENGINE AT HEAVY LOAD?
YES
NO
46
STOP FP2
48
ENGINE IN OPERATION?
YES
NO
50
RELEASE RELAY (STOP FP1)
52
INPUT 0 INTO F
54
OPERATE FP2 IN L MODE
56
OPERATE FP2 IN M MODE
58
ACTIVATE RELAY (OPERATE FP1)
60
FP1 IN OPERATION?
YES
NO
62
INPUT 1 INTO F
64
OPERATE FP2 IN Hi MODE
66
IGNITION SW. TURNED OFF?
YES
NO
68
STOP1 FP2
70
INPUT 0 INTO F
RETURN

FUEL SUPPLY SYSTEM FOR INTERNAL COMBUSTION ENGINE

CROSS REFERENCE TO RELATED APPLICATION

This application is based upon and claims the benefit of priority of Japanese Patent Applications No. 2006-90837 filed on Mar. 29, 2006, and No. 2006-102811 filed on Apr. 4, 2006, the contents of which are incorporated herein by reference.

FIELD OF THE INVENTION

The present invention relates to a fuel supply system having a fuel pump and a pressure regulator that regulates a fuel discharging pressure of the fuel pump.

BACKGROUND OF THE INVENTION

In conventional fuel supply systems, a fuel pump sucks fuel from a fuel tank and supplies the fuel out of the fuel pump into an internal combustion engine. Some fuel supply systems are provided with a pressure regulator to regulate a fuel supply pressure, i.e., a pressure of the fuel at which the fuel is discharged out of the fuel supply system, as disclosed in JP-H05-321783-A, JP-H05-039763-A, JP-H06-129325-A (which has counterparts U.S. Pat. Nos. 5,359,976, 5,471,962, 5,577,482, and EP-0593053-B1, EP-0606106-B1), and JP-2002-310025-A. In general, the pressure regulators incorporated in the fuel supply systems have a construction in which a diaphragm (pressure receiving portion) partitions a fuel pressure regulating chamber from a back pressure chamber. The diaphragm is bulged by forces applied by a fuel pressure in the back pressure chamber and by a fuel pressure in the fuel pressure regulating chamber. Thus, the fuel pressure regulating chamber discharges the fuel in accordance with the fuel pressure in the back pressure chamber and the fuel pressure in the fuel pressure regulating chamber so as to regulate the fuel pressure in the fuel pressure regulating chamber. The fuel pressure in the fuel pressure regulating chamber decreases when the fuel in the fuel pressure regulating chamber is discharged, and then the fuel is supplied from the fuel pump into the fuel pressure regulating pressure of the pressure regulator, so as to regulate the fuel supply pressure of the fuel supply system.

The fuel pressure in the fuel pressure regulating chamber, which is regulated by the bulge of the diaphragm, is referred to as a set pressure of the pressure regulator hereafter. The set pressure of the pressure regulator is determined by the pressure in the back pressure chamber, a ratio between a pressure receiving area on one surface of the diaphragm, which is subjected to the pressure in the back pressure chamber and a pressure receiving area on the other surface of the diaphragm, which is subjected to the fuel pressure in the fuel pressure regulating chamber, etc. In a construction in which an elastic member such as a spring applies a biasing force onto the diaphragm, the set pressure of the pressure regulator is determined also by the biasing force of the elastic member. The pressure introduced into the back pressure chamber of the pressure regulator is: an atmospheric pressure; a negative pressure in an intake pipe (refer to JP-H06-129325-A); any one of the negative pressures in the intake pipe and the atmospheric pressure (refer to JP-H05-039763-A); a fuel pressure regulated by another pressure regulator (refer to JP-2002-310025-A), etc.

In this regard, it is recently demanded to raise the fuel supply pressure of the fuel supply system, due to the following reasons.

Firstly, high fuel supply pressure is necessary to compress and liquefy fuel vapors generated in fuel piping. For example, the fuel vapors are prone to be generated when the fuel pump is started on a condition that a fuel temperature is high. High fuel supply pressure is required especially in this condition.

Next, high fuel supply pressure is necessary to promote atomization of fuel injections into the internal combustion engine. For example, it is necessary to promote the atomization of the fuel especially when the internal combustion engine is driving at heavy load, so as to raise an output power of the internal combustion engine.

Further, it is necessary to promote atomization of fuel injections in order to decrease unburned fuel in emission gas discharged out of the internal combustion engine, and to improve startability of the internal combustion engine in low and high temperature conditions. In order to promote the atomization of fuel injections, high fuel supply pressure, at which the fuel is discharged out of the fuel supply system and supplied to fuel injection valves, is effective, in addition to refinements of the fuel injection valves such as adjustments of shapes of injection holes, etc.

When the fuel supply pressure is raised as described above, however, some disadvantages occur. For example, an operating current of the fuel pump rises and an alternator is subjected to heavy load. This decreases fuel efficiency of the vehicle, and shortens a useful life of brushes of a motor for driving the fuel pump, to decrease endurance of the fuel supply system.

In order to raise fuel supply pressure of the fuel supply system, it is necessary to raise the set pressure of the pressure regulator.

In order to raise the set pressure of the pressure regulator, the elastic member such as a spring is upsized to increase the biasing force applied onto the diaphragm, for example. However, the pressure regulator becomes bulky when the elastic member is upsized.

In this regard, JP-2002-310025-A discloses a fuel supply system in which the pressure in the back pressure chamber of a first pressure regulator, which is for regulating the fuel supply pressure of the fuel supply system, is regulated by a second pressure regulator, which is for regulating the back pressure of the first pressure regulator. By setting the set pressure of the second pressure regulator at a high value, it is possible to raise the set pressure of the first pressure regulator without upsizing the pressure regulators.

In the fuel supply system disclosed in JP-2002-310025-A, however, a pressure of excessive fuel, which is discharged out of the first pressure regulator, is adjusted and introduced into the back pressure chamber of the second pressure regulator. In this construction, a quantity of the excessive fuel, which is discharged out of the first pressure regulator in accordance with a fuel consumption quantity of the internal combustion engine, i.e., a quantity of the fuel, which is introduced into the back pressure chamber of the first pressure regulator after its pressure is regulated by the second pressure regulator, is not stable. As a result, the fuel pressure in the back pressure chamber of the first pressure regulator fluctuates depending on the fuel consumption quantity of the internal combustion engine. This causes instability of the set pressure of the first pressure regulator, i.e., instability in the fuel supply pressure of the fuel supply system, which is regulated by the first pressure regulator.

SUMMARY OF THE INVENTION

The present invention is achieved in view of the above-described issues, and has an object to provide a fuel supply system that endures in an operation to pressurize fuel at high pressure and to supply high pressure fuel.

Another object of the present invention is to provide a fuel supply system that can regulate fuel at high pressure and supply high pressure fuel without upsizing its pressure regulator.

The fuel supply system for supplying fuel from a fuel tank to a fuel supply piping has a back pressure introducing passage and a fuel pump. The fuel pump supplies the fuel from the fuel tank to the fuel supply piping and to the back pressure introducing passage. The pressure regulator is provided with a case, a diaphragm, a fuel pressure regulating port, a back pressure introducing port, a relief port, and a relief valve. The diaphragm partitions an inner space of the case into a fuel pressure regulating chamber and a back pressure chamber. The fuel pressure regulating port communicates the fuel pressure regulating chamber to the fuel supply piping. The back pressure introducing port communicates the back pressure chamber to the back pressure introducing passage. The relief port communicates the fuel pressure regulating chamber to the fuel tank. The relief valve operates in accordance with a bulging degree of the diaphragm. The relief valve opens the relief port when a fuel pressure in the fuel pressure regulating chamber is larger than a relief pressure that bulges the diaphragm toward fuel pressure regulating chamber. The relief valve closes the relief port when the fuel pressure in the fuel pressure regulating chamber is not larger than the relief pressure. The relief pressure is adjusted by controlling a fuel pressure in the back pressure chamber of the pressure regulator.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

FIG. 6 is a flow chart showing a control procedure of a back pressure pump controller of the fuel supply system according to the first embodiment;

DETAILED DESCRIPTION OF THE PREFERRED EMBODIMENTS

First Embodiment

Figure 1:
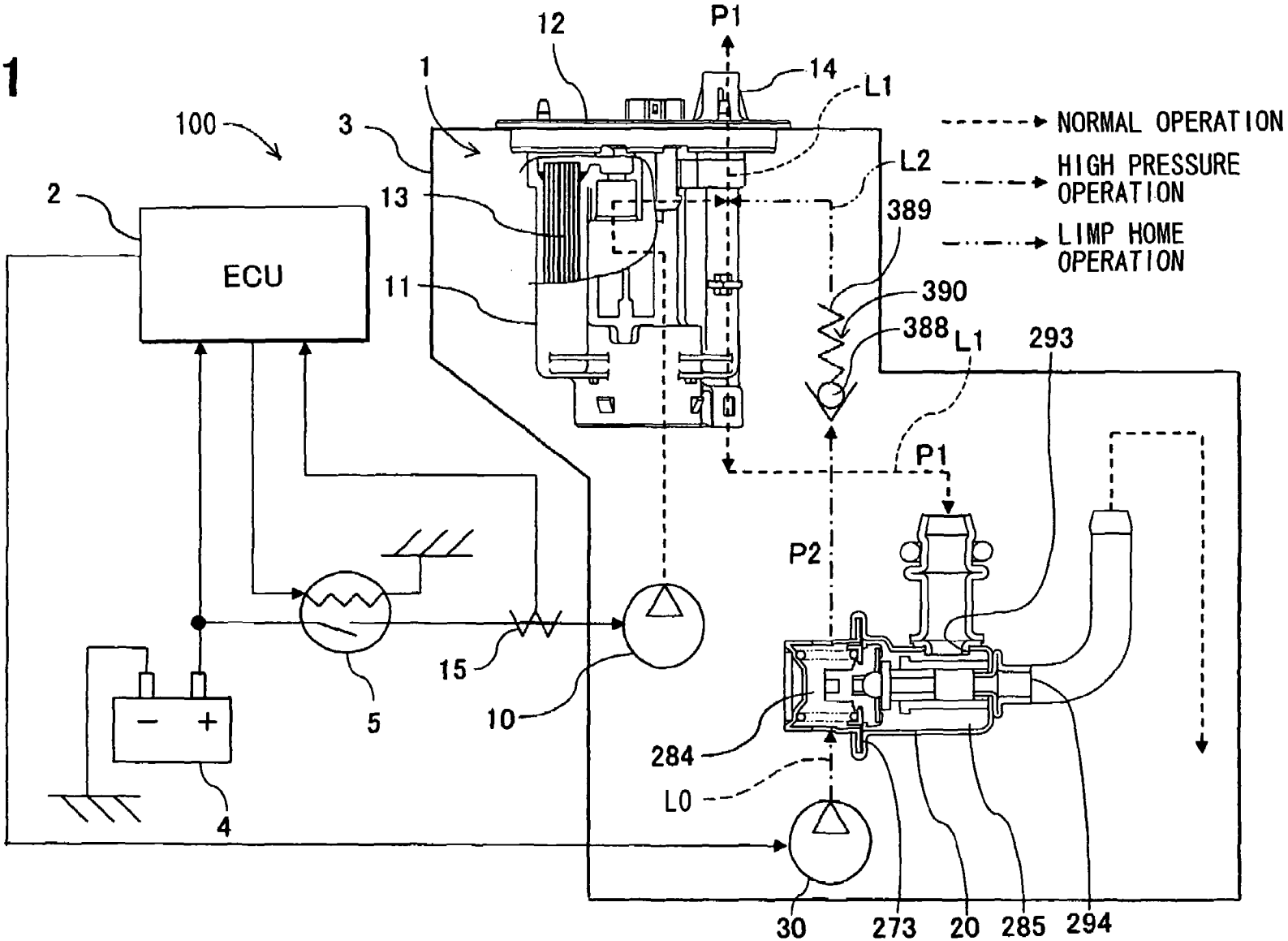
FIG. 1 is a schematic diagram showing a fuel supply system according to a first embodiment of the present invention.

FIGS. 1 to 4 illustrate a fuel supply system 100 according to a first embodiment of the present invention. As shown in FIG. 1, the fuel supply system 100 includes a fuel pump module 1, an electrical control unit (ECU) 2, etc. The fuel pump module 1 is installed inside a fuel tank 3. The fuel pump module 1 sucks fuel from the fuel tank 3, pressurizes the fuel, and supplies the fuel to a delivery pipe (not shown). The delivery pipe is connected to fuel injectors (not shown), each of which is installed on a cylinder of an internal combustion engine to inject the fuel. The fuel supply system 100 according to the first embodiment is a returnless fuel supply system that is not provided with a return pipe that returns excessive fuel from a delivery pipe to the fuel tank 3.

The ECU 2 is supplied with electric power from a battery 4. The ECU 2 controls operation of a primary pump 10, which is provided in the fuel pump module 1, in accordance with a command signal that indicates optimum fuel pressure for each driving state of the engine, and fuel pressure in the delivery pipe. The ECU 2 controls the fuel pressure in the delivery pipe in this manner. Specifically, the ECU 2 controls a relay 5 to switch the primary pump 10 on and off. Further, the ECU 2 controls operation of the fuel injectors to adjust fuel injection quantity. The ECU 2 serves as a back pressure pump controller according to the present invention.

In the schematic diagram of FIG. 1, the primary pump 10 is shown outside a casing 11; however, the primary pump 10 is installed inside the casing 11 in practical arrangement. The casing 11 is supported by a lid member 12 that closes an opening end of the fuel tank 3.

As indicated by short dashed arrow lines in FIG. 1, the fuel discharged out of the primary pump 10 flows through a fuel filter 13 in the casing 11 into a pressure regulator 20 in a normal operation time of the fuel supply system 100. The fuel, a pressure of which is regulated by the pressure regulator 20, is supplied out of a discharge port 14, which is provided in the lid member 12, to the delivery pipe. The excessive fuel, which is discharged out of the pressure regulator 20, is returned to the fuel tank 3.

Figure 2:
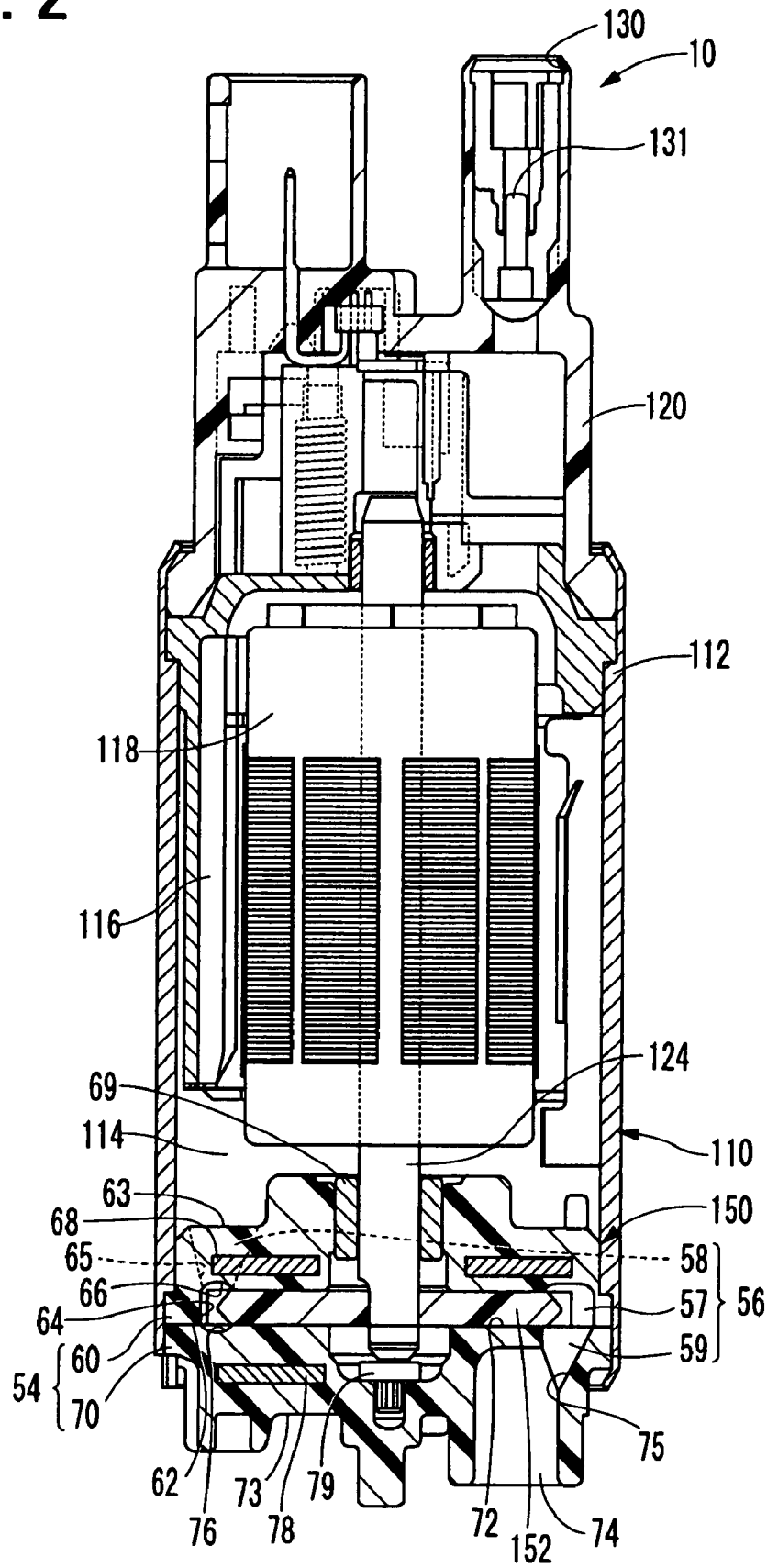
FIG. 2 is a cross-sectional view showing a primary pump of the fuel supply system according to the first embodiment.

A construction of the primary pump 10 is described in the following, referring to FIG. 2.

The primary pump 10 is an electrically driven pump, and provided with a motor portion 110 and a pump portion 150. The motor portion 110 is a DC motor having brushes. The motor portion 110 has a construction in which a cylindrical housing 112 forms a motor chamber 114 therein, a plurality of permanent magnets 116 are arranged along a circumference of the housing 112, and an armature 118 is located inside of the circular array of the permanent magnets 116 to be coaxial to the circular array.

When the armature 118 is supplied with electric power via the brushes (not shown) from the battery 4, a rotation axis 124, which rotates integrally with the armature 118, rotationally moves an impeller 152 of the pump portion 150. A fuel discharge port 130 is formed in an end cover 120. The fuel is pressurized by the rotating impeller 152, introduced into the motor chamber 114, and discharged out of the fuel discharge port 130 to a flow passage in which the fuel filter 13 is installed within the casing 11 as shown in FIG. 1. The fuel discharge port 130 is provided with a check valve 131, so as to prevent the fuel from flowing backward from the fuel discharge port 130 into the housing 112. Thus, it is possible to keep the fuel pressure in the delivery pipe even when the primary pump 10 is stopped.

Figure 3:
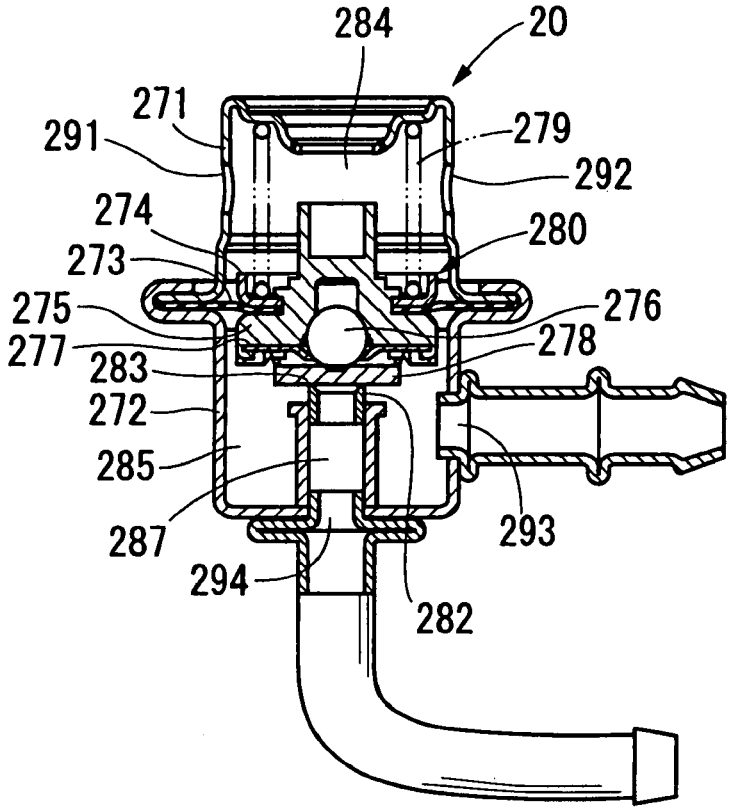
FIG. 3 is a cross-sectional view showing a pressure regulator of the fuel supply system according to the first embodiment.

A construction of the pressure regulator 20 is described in the following, referring to FIG. 3.

The pressure regulator 20 includes: a back pressure side case 271; a pressure regulation side case 272; a rubber diaphragm 273; a spring seat 274; a valve guide 275; a ball 276; a fastening 277; a valve head member 278; a spring 279; and a valve seat member 282. The diaphragm 273, the spring seat 274, the valve guide 275, the ball 276 and the valve head member 278 form a moving body 280 that is integrally displaced.

An outer circumferential portion of the rubber diaphragm 273 is tightly sandwiched between the back pressure side case 271 and the pressure regulation side case 272, and an inner circumferential portion of the diaphragm 273 is tightly sandwiched between the spring seat 274 and the valve guide 275. The ball 276 is pushed on the valve guide 275 by the fastening 277. The valve head member 278 has a plate-like shape and moves integrally with the ball 276. The back pressure chamber 284 is defined by the back pressure side case 271 and the moving body 280. The spring 279 is installed in the back pressure chamber 284, and biases the moving body 280 in a direction to seat the valve head member 278 onto the valve seat 283 of the valve seat member 282.

The valve seat member 282, which has a cylindrical shape, is press-fitted into and blazed to the pressure regulation side case 272. The valve seat member 282 has a discharge passage 287 that extends in an axial direction thereof. The discharge passage 287 communicates a fuel pressure regulating chamber 285 with a fuel discharge port 294. The valve seat 283 is formed on the fuel pressure regulating chamber (285)-side end of the discharge passage 287. When the valve head member 278 is seated on the valve seat 283, a communication between the fuel pressure regulating chamber 285 and the fuel discharge port 294 is interrupted. When the valve head member 278 is lifted apart from the valve seat 283, the communication between the fuel pressure regulating chamber 285 and the fuel discharge port 294 is allowed.

A communicating hole 291, which is formed on the back pressure side case 271, communicates the back pressure chamber 284 with a fuel discharge port 306 of a back pressure control pump 30, which is described hereafter. The pressure in the back pressure chamber 284 is controlled in accordance with an operation of the back pressure control pump 30. The pressure in the back pressure chamber 284 acts on the moving body 280 in a direction to seat the valve head member 278 onto the valve seat 283.

Another communicating hole 292, which is formed on the back pressure side case 271, is connected to a piping (not shown) that serves as a secondary fuel passage L2 to lead the fuel in the back pressure chamber 284 to a fuel discharge passage L1, which discharges the fuel out of the fuel discharge port 130 of the primary pump 10 as shown in FIG. 1. The secondary fuel passage L2 is provided with a check valve 390, which serves as a secondary passage shutting valve according to the present invention. The check valve 390 includes a valve body 388 that opens and closes the secondary fuel passage L2, and a spring 389 that biases the valve body 388 in a direction to close the secondary fuel passage L2. The check valve 390 restricts a fuel flow in the secondary fuel passage L2 to a direction from the back pressure chamber 284 to the fuel discharge passage L1 that is connected to the fuel discharge port 130 of the primary pump 10.

The check valve 390 opens the secondary fuel passage L2 when a pressure difference between the pressure P1 in the fuel discharge passage L1, which is connected to the fuel discharge port 130 of the primary pump 10, and the pressure P2 in the back pressure chamber 284 becomes larger than a set pressure. Thus, the check valve 390 closes the secondary fuel passage L2, and the fuel flows as indicated by short dashed arrow lines, in the normal operation time in which the primary pump 10 normally operates. In a high pressure operation time in which both of the primary pump 10 and the back pressure control pump 30 normally operate, the check valve 390 keep closing the secondary fuel passage L2, and the fuel flows as indicated by single-dotted chain arrow line in FIG. 1.

When the pressure P1 in the fuel discharge passage L1 becomes smaller than the pressure P2 in the back pressure chamber 284 due to a failure of the primary pump 10 or some other cause, the pressure P1 further decreases to make the pressure difference between the pressures P1, P2 larger than the set pressure of the check valve 390. Then, the check valve 390 opens the secondary fuel passage L2, and the fuel flows as indicated by double-dotted chain arrow line in FIG. 1.

Even if a fuel discharge quantity out of the back pressure control pump 30 increases on a condition that the primary pump 10 normally operates, the pressure P2 in the back pressure P2 chamber 284 increases, and the pressure P1 in the fuel discharge passage L1 also increases. Thus, the pressure difference between the pressures P1, P2 does not become larger than the set pressure of the check valve 390, and the secondary fuel passage L2 is kept closed. Accordingly, while the primary pump 10 normally operates, the secondary fuel passage L2 is kept closed even if the fuel discharge quantity out of the back pressure control pump 30 increases.

Figure 5:
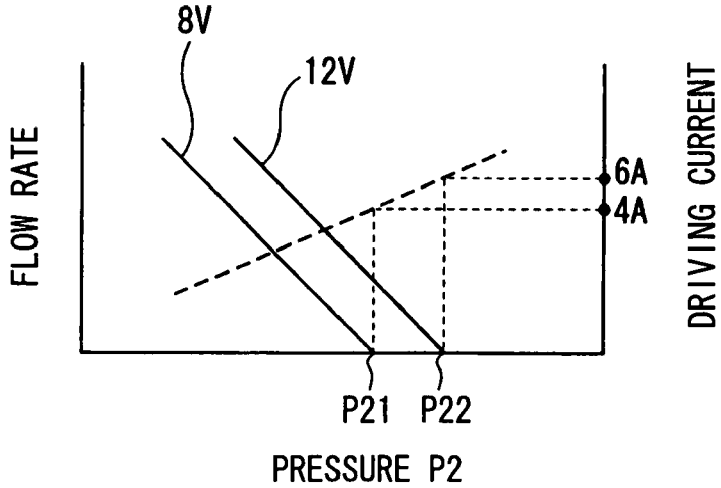
FIG. 5 is a graph showing a relationship between a fuel discharging pressure and a fuel discharge quantity of the back pressure control pump of the fuel supply system according to the first embodiment.

FIG. 5 depicts an example of relationship between fuel discharging pressure and fuel discharge quantity of the back pressure control pump 30 in accordance with driving voltage (and driving current) applied to the back pressure control pump 30. As indicated by solid lines in FIG. 5, the fuel discharge quantity decreases as the fuel discharging pressure P2 increases. On a condition that the fuel discharge quantity is constant, the fuel discharging pressure P2 increases as the driving voltage (and the driving current) increases. Accordingly, when the back pressure control pump 30 starts driving in a state that the secondary fuel passage L2 is closed by the check valve 390, the fuel discharge quantity gradually decreases and the fuel discharging pressure gradually increases as the time is elapsed. When the fuel discharge quantity becomes zero, the fuel discharging pressure P2 becomes constant at pressures P21, P22 as shown in FIG. 5. The pressure P21 when the driving voltage is 8V (when the driving current is 4 A) is smaller than the pressure P22 when the driving voltage is 12V (when the driving current is 6 A). Thus, it is possible o regulate the pressure P2 in the back pressure chamber 284 by adjusting the driving voltage applied to the back pressure control pump 30. A broken line in the graph of FIG. 5 indicates a relationship between the pressure P2 and the driving current on a condition that the fuel discharge quantity of the back pressure control pump 30 is zero.

A communicating hole 293, which is formed on the pressure regulation side case 272, communicates the fuel pressure regulating chamber 285 with the fuel discharge passage L1 that connected to the fuel discharge port 130 of the primary pump 10. The pressure in the fuel pressure regulating chamber 285 is equal to the fuel discharging pressure of the primary pump 10, and acts on the moving body 280 in a direction to lift the valve head member 278 apart from the valve seat 283. The pressure regulation side case 272 has the fuel discharge port 294 on an opposite side from the back pressure side case 271, to discharge the excessive fuel.

The pressure regulator 20 regulates the pressure of the fuel that flows out of the fuel filter 13 into the fuel discharge passage L1 at a predetermined high pressure (600 kPa, for example), by discharging the excessive fuel out of the fuel discharge port 294 in accordance with the fuel discharge quantity of the primary pump 10. The value of the above-mentioned high pressure is determined in accordance with the pressure in the back pressure chamber 284, which is controlled by the operation of the back pressure control pump 30, and corresponds to a relief pressure according to the present invention. The fuel, the pressure of which is regulated at the high pressure, is supplied from the fuel discharge passage L1 to the delivery pipe on the engine side.

The valve head member 278 in the valve head the pressure regulator 20 is located at a position so as to balance a force, which is applied by the fuel pressure in the back pressure chamber 284 onto the moving body 280 in a direction to seat the valve head member 278 onto the valve seat 283, a force, which is applied by the fuel pressure in the fuel pressure regulating chamber 285 onto the moving body in a direction to lift the valve head member 278 apart from the valve seat 283, and a biasing force, which is applied by the spring (biasing member) 279 onto the moving body in a direction to seat the valve head member 278 onto the valve seat 283.

When the fuel discharge quantity from the primary pump 10 into the fuel pressure regulating chamber 285 becomes large, the force, which moves the moving body 280 in a direction to lift the valve head member 278 apart from the valve seat 283, increases, and then the valve head member 278 lifts off the valve seat 283. When the valve head member 278 is lifted off the valve seat 283, the excessive fuel is discharged out of the fuel pressure regulating chamber 285 to the fuel discharge port 294. The opening clearance between the valve head member 278 and the valve seat 283 changes in accordance with a quantity of the excessive fuel, to balance the fuel pressure in the fuel pressure regulating chamber 285 with the pressure in the back pressure chamber 284 and the biasing force of the spring 279, and to regulate the fuel pressure in the fuel pressure regulating chamber 285. The excessive fuel discharged out of the fuel discharge port 294 returns into the fuel tank 3.

Figure 4:
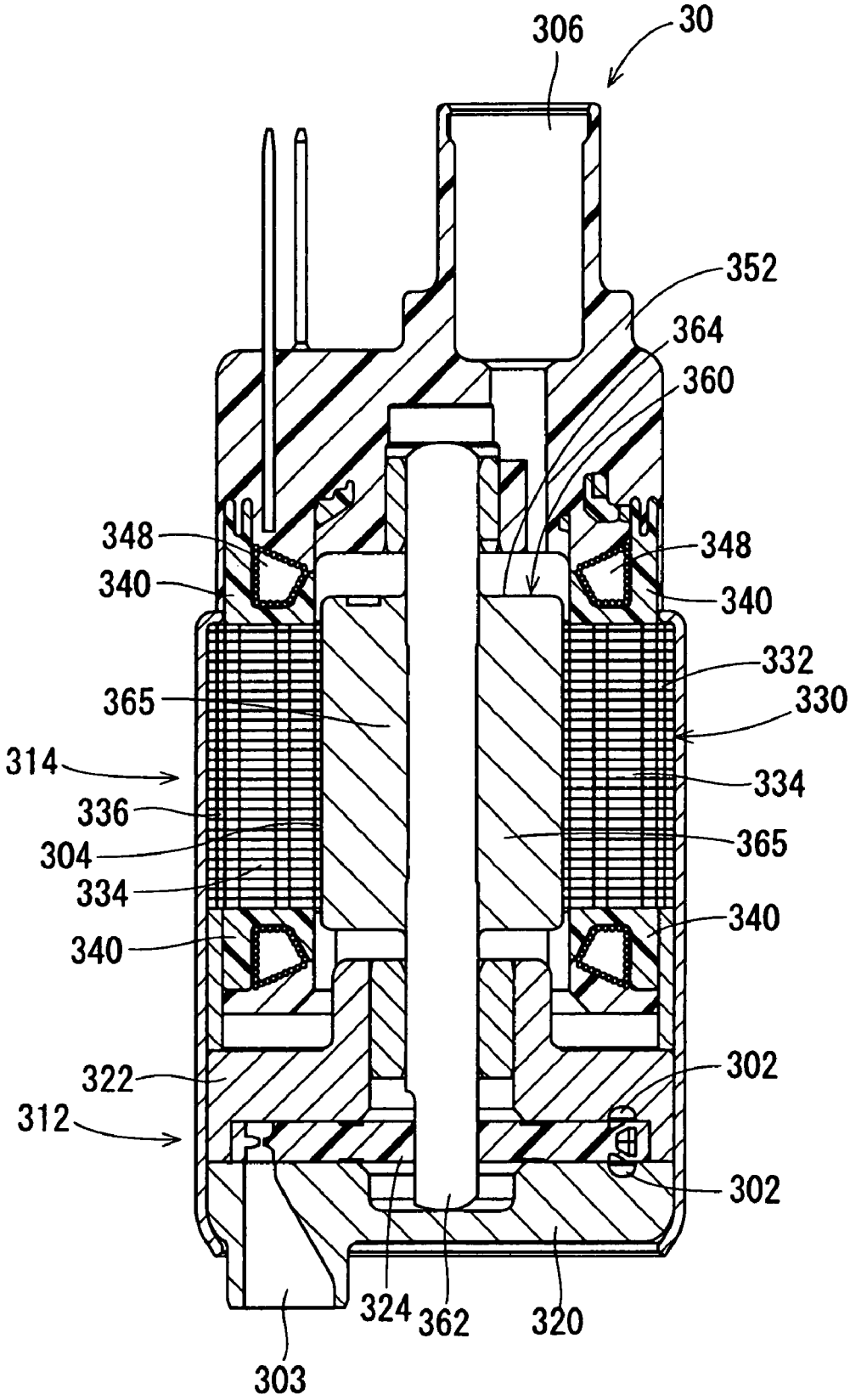
FIG. 4 is a cross-sectional view showing a back pressure control pump of the fuel supply system according to the first embodiment.

A construction of the back pressure control pump 30 is described in the following, referring to FIG. 4.

The back pressure control pump 30 is electrically driven one, and provided with a pump portion 312, and a motor portion 314 that rotationally drive the pump portion 312. The motor portion 314 of the back pressure control pump 30 has an output power smaller than that of the motor portion 110 of the primary pump 10. In the first embodiment, a pump having a maximum discharge quantity of 80-150 liters per hour is suitable for the primary pump 10, and a pump having a maximum discharge quantity of approximately 30 liters per hour is suitable for the back pressure control pump 30.

The pump portion 312 is a turbine pump (centrifugal pump) having pump cases 320, 322 and an impeller 324. The pump cases 320, 322 house the impeller (rotational member) rotatably therein. C-shaped pump passages 302 are formed between the pump case 320 and the impeller 324 and between the pump case 322 and the impeller 324. The fuel in the fuel tank 3 is sucked through a fuel suction port 303, which is formed on the pump case 320, pressurized by a rotation of the impeller 324, and pressure-supplied to the motor portion 314. The fuel pressure-supplied to the motor portion 314 flows through a fuel passage 304, which is provided between a stator core 330 and a rotor 360, and supplied out of the fuel discharge port 306 to the back pressure chamber 284 of the pressure regulator 20.

The motor portion 314 is an inner rotor brushless motor. The motor portion 314 includes the stator core 330, a pair of insulators 340 and a pair of coils 348. The stator core 330 is formed of coil cores 332. The coil core 332 has teeth 334 that extend in radial directions, and peripheral cores 336 that extend along a circumference on a radially outer side of the teeth 334. Each of the insulators 340 is press-fitted on both axial end sides of the coil cores 332. Each of the insulators 340 has a bobbin groove, in which conducting wires are wound to form the coils 348.

The rotor 360 has a rotation axis 362 and permanent magnets 306, and the rotor 360 is rotatably installed inside an inner circumference of the stator core 330. The permanent magnets 306 form eight magnetic pole portions 365 that are aligned to surround the rotation axis 362. The eight magnetic pole portions 365 are magnetized to provide positive and negative magnetic poles on their circumferences that face the coil cores 332 so that the positive and negative magnetic poles alternately surround the rotation axis 362.

A switching circuit (not shown) switches driving current supplied to the coil 348, so as to control magnetic pole generations of the coils 348. In order to switch the driving current supplied to the coils 348 to rotate the rotor 360, it is necessary to detect rotational position of the rotor 360. The rotational position of the rotor 360 is detected by a detecting device such as a Hall device, for example, and the driving current is switched in accordance with detection signals of the detecting device. Alternatively, it is also possible to detect the rotational position of the rotor 360 by energizing some of the coils 348, and detecting induction electromotive forces generated in the other coils 348 (for example, by energizing four coils among totally six coils, and detecting the induction electromotive forces generated in the other two coils). The switching circuit may be incorporated in the back pressure control pump 30. In another way, the switching circuit may be installed outside the back pressure control pump 30 (in the ECU 2, for example).

When electric power is supplied from the battery 4 to the coil 348, the rotation axis 362, which rotates integrally with the rotor 360, rotates the impeller 324 of the pump portion 312. The fuel is pressurized by the rotating impeller 324, introduced into a motor chamber, and discharged out of the fuel discharge port 306, which is formed in an end cover 352, to the communicating hole 293 of the pressure regulator 20 shown in FIG. 3. The fuel discharge port 306 is not provided with any check valve, differently from the primary pump 10 in which the fuel discharge port 130 is provided with the check valve 131. Thus, when the back pressure control pump 30 stops, the fuel in the back pressure chamber 284 of the pressure regulator 20 flows backward in the back pressure control pump 30, and discharged through the pump passage 302 and the fuel suction port 303 into the fuel tank 3.

The ECU 2 is provided with a CPU, a ROM, a RAM, an input circuit, an output circuit, etc. (not shown). When electric power is supplied from the battery 4 to the ECU 2, the ECU 2 controls the operations of the primary pump 10 and the back pressure control pump 30, pursuant to a control procedure shown in FIG. 6. In this control procedure, the fuel discharging pressure of the primary pump 10, which is regulated by the pressure regulator 20, is controlled by the operation of the back pressure control pump 30. In a fall back operation time (limp home operation time) due to a failure of the primary pump 10 or some other reason, the back pressure control pump 30 supplies the fuel from the fuel tank 3, instead of the delivery pipe the primary pump 10. Namely, the control procedure shown in the flow chart of FIG. 6 switches the fuel supply system 100 between the fall back operation and an operation to regulate the fuel discharging pressure of the primary pump 10.

(1) Firstly, the ECU 2 starts the control procedure at a predetermined pump operation monitoring timing, and determines whether an error of the primary pump 10 has been detected or not in a step 40. Specifically, the fuel supply system 100 can detect the error of the primary pump 10 by the ECU 2 in a step 60, and sets a flag F to 1 to memorize the error of the primary pump 10. Then, the ECU 2 determines whether the flag F is 1 or not in the step 40.

(2) Next, the ECU 2 determines a starter motor for starting the engine is working or not in a step 42, and further determines the engine is at a heavily loaded state or not in a step 44. If the ECU 2 determines that the starter motor is working, i.e., the engine is in starting state in the step 42, the ECU 2 operates the back pressure control pump 30 in a middle mode by applying a predetermined driving voltage (or driving current) to the back pressure control pump 30 in a step 56, and operates the primary pump 10 at the same time by activating the relay 5 in a step 58.

If the ECU 2 determines that the starter motor is not working in the step 42 and further determines that the engine is at heavily loaded state in the step 44, the ECU 2 operates the back pressure control pump 30 in a low mode by applying another predetermined driving voltage (or driving current) to the back pressure control pump 30, and operates the primary pump 10 at the same time in the step 58. The heavily loaded state of the engine includes an accelerating state of a vehicle, for example.

(3) If the ECU 2 determines that the flag F is not 1 in the step 40, that the starter motor is not working in the step 42, and that the engine is not in heavily loaded state in the step 44, the ECU 2 stops the back pressure control pump 30 in a step 46. Then, if the ECU 2 determines that the engine is driving in a step 48, the ECU 2 starts the primary pump 10 or keeps operating the primary pump 10, by activating the relay 5 in the step 58. That is, the fuel supply system 100 is in the normal operation time in the step 58.

If the ECU 2 determines that at least one branch condition is not satisfied in the steps 40, 42, 44, the ECU 2 starts the back pressure control pump 30 in any one of the steps 54, 56, 64. That is, when the primary pump 10 is not in failure and the engine is starting or driving in heavily loaded state, the pressure in the back pressure chamber 284 increases, and the pressure P1 in the fuel discharge passage L1, which is connected to the fuel discharge port 130 of the primary pump 10, increases. If the engine is in normally loaded state, the pressure in the back pressure chamber 284 remains small, and the pressure P1 in the fuel discharge passage L1, which is connected to the fuel discharge port 130 of the primary pump 10, is not increased. In FIG. 6, "FP2" indicates the back pressure control pump 30, and "FP1" indicates the primary pump 10.

(4) As described above, the ECU 2 changes the fuel discharging pressure of the back pressure control pump 30 in accordance with conditions of the fuel supply system 100 when it drives the back pressure control pump 30. When the flag F is set to 1 and any failure is present in the primary pump 10, etc., the ECU 2 operates the back pressure control pump 30 in a high mode in the step 64, in which the fuel discharging pressure and the fuel discharge quantity of the back pressure control pump 30 is maximized.

(5) When the ECU 2 determines that no failure is present in the primary pump 10, etc., and that the starter motor is working and the engine is starting, the ECU 2 operates the fuel supply system 100 in the middle mode in the step 56, in which the fuel discharging pressure of the back pressure control pump 30 is smaller than in the high mode. Thus, the pressure in the back pressure chamber 284 is larger than in a state in which the back pressure control pump 30 is stopped in the step 46. As a result, the pressure P1 in the fuel discharge passage L1, which is connected to the fuel discharge port 130 of the primary pump 10, is set to a large value.

(6) When the ECU 2 determines that no failure is present in the primary pump 10, etc., and that the engine is driving in a state that the starter motor is stopping, the ECU 2 operates the fuel supply system 100 in the low mode in the step 54, in which the fuel discharging pressure of the back pressure control pump 30 is smaller than in the middle mode. Thus, the pressure in the back pressure chamber 284 is larger than in a state in which the back pressure control pump 30 is stopped in the step 46, and smaller than in the middle mode. As a result, the pressure P1 of the fuel discharge passage L1, which is connected to the fuel discharge port 130 of the primary pump 10, is set to a value larger than when the back pressure control pump 30 is stopping, and smaller than in the middle mode.

(7) After the process of the step 46, the ECU 2 determines whether the engine is driving or not in the step 48. If the ECU 2 determines that the engine is not driving in the step 48, the ECU 2 releases the relay 5 in the step 50 so as to stop the primary pump 10.

(8) After the process of the step 58, the ECU 2 determines whether the primary pump 10 is normally operating or not on a condition that the relay 5 is activated in the step 60. As shown in FIG. 1, the fuel supply system 100 is provided with a failure detector 15 that detects a failure of the primary pump 10. The ECU 2 detects the failure of the primary pump 10 in accordance with a detection signal sent from the failure detector 15. In the first embodiment, the failure detector 15 detects a driving voltage of the primary pump 10. The ECU 2 determines that the failure of the primary pump 10 (e.g., a break in the wiring) when the driving voltage is smaller than a predetermined set value.

(9) If the ECU 2 determines that the primary pump 10 is in normal operation in the step 60, the ECU 2 sets the flag F to 0 in a step 52. If the ECU 2 determines that the primary pump 10 is not in normal operation in the step 60, the ECU 2 sets the flag F to 1 in a step 62. After the processes of the step 52, 62, the control procedure of the primary pump 10 and the back pressure control pump 30 is finished.

(10) After the process of the step 64, the ECU 2 determines in a step 66 whether an ignition switch (not shown) is turned on or not. If the ECU 2 determines that the ignition switch is turned on, the control procedure is finished. If the ECU 2 determines that the ignition switch is turned off, the ECU 2 determines that a fall back operation is not necessary, and stops the operation of the back pressure control pump 30 in a step 68. Then, the ECU 2 sets the flag F to 0 in a step 70, and completes the control procedure.

Advantages of the fuel supply system 100 according to the first embodiment are described in the following. The fuel supply system 100 is provided with the back pressure control pump 30 for supplying the fuel to the back pressure chamber 284 of the pressure regulator 20, in addition to the primary pump 10 for supplying the fuel to the delivery pipe. Accordingly, the fuel supply system 100 can adjust the fuel pressure in the back pressure chamber 284 by controlling the fuel discharging pressure of the back pressure control pump 30. Further, when the primary pump 10 is in normal operation, the normal operation of the ECU 2, which serves as the back pressure pump controller according to the present invention, switches the fuel discharging pressure of the primary pump 10 in the steps 46, 54, 56 in FIG. 6. Thus, the fuel supply system 100 can adjust the pressure P1 of the fuel discharge passage L1 of the primary pump 10, in accordance with the driving conditions of the engine, which are detected in the steps 42, 44.

Especially in the returnless fuel supply system 100, relatively large fuel discharging pressure of the primary pump 10 is required. This raises an operating current of the primary pump 10, to cause malfunctions to raise a load acting on the alternator, to shorten a useful life of the brushes of the primary pump 10, etc. Accordingly, the fuel supply system 100 according to the present embodiment, which is provided with the back pressure control pump 30, prevents the above malfunctions and is suitable for the returnless fuel supply system 100, because the fuel supply system 100 according to the present embodiment can raise the fuel discharging pressure only in a required time, so as to improve durability of the fuel supply system 100.

Further, the fuel supply system 100 according to the first embodiment is provided with the secondary fuel passage P2, which leads the fuel discharged out of the back pressure control pump 30 to the fuel discharge passage L1 of the primary pump 10. Thus, even when the primary pump 10 is in failure, the fuel supply system 100 can supply the fuel from the back pressure control pump 30 via the secondary fuel passage L2 to the delivery pipe. Accordingly, the back pressure control pump 30 of the fuel supply system 100 according to the first embodiment is provided with a fall back function (limp home function) when the primary pump 10 is in failure.

Furthermore, in the fuel supply system 100 according to the first embodiment, the secondary fuel passage L2 is connected to the back pressure chamber 284. Thus, the fuel supply system 100 requires a means that closes the secondary fuel passage L2 when the primary pump 10 is normally operating, and opens the secondary fuel passage L2 when the primary pump 10 is in failure. In this regard, the fuel supply system 100 according to the first embodiment is provided with the check valve 390, which serves as a secondary passage shutting valve according to the present invention, in the secondary fuel passage L2. Thus, when a pressure in the fuel discharge side of the primary pump 10 becomes smaller than a predetermined value, it is determined that the primary pump 10 is in failure, and the check valve 390 opens the secondary fuel passage L2. Relatively to a construction provided with a failure detecting means and an electromagnetic valve so that the electromagnetic valve opens the secondary fuel passage L2 when the failure detecting means detects a failure of the primary pump 10, the fuel supply system 100 according to the present embodiments uses the relatively low-cost check valve 390 serving as the shut-off valve, to decreases a manufacturing cost of the fuel supply system 100.

Still further, the fuel supply system 100 according to the first embodiment, the secondary fuel passage L2 is provided with the check valve 390, which serves as the secondary passage shutting valve according to the present invention, and the check valve 390 limits a fuel flow in the secondary fuel passage L2 to a direction from the back pressure chamber 284 to the fuel discharge passage L1 of the primary pump 10. Then, the check valve 390 opens the secondary fuel passage L2 when a difference between the pressure in the fuel discharge side of the primary pump 10 and the pressure in the back pressure chamber 284 becomes larger than a set pressure.

In this manner, the fuel supply system 100 according to the first embodiment incorporates the check valve 390 that is relatively cheep with respect to electromagnetic valve, to decrease the manufacturing cost of the fuel supply system 100.

Still further, in the fuel supply system 100 according to the first embodiment, a turbine pump having no seal function is used for the pump portion 312 of the back pressure control pump 30. Thus, when the fuel supply system 100 is switched from the high pressure fuel supplying operation in which both of the primary pump 10 and the back pressure control pump 30 are in normal operations (as indicated by single-dotted chain arrow line in FIG. 1) to the normal operation in which only the primary pump 10 is in normal operation (as indicated by short-dashed line in FIG. 1), the operation of the back pressure control pump 30 is stopped to flow the fuel in the back pressure chamber 284 backward in the back pressure control pump 30 and discharged through the pump passage 302 and the fuel suction port 303 into the fuel tank 3. Thus, the fuel pressure in the back pressure chamber 284 is easily decreased to switch the fuel supply system 100 from the high pressure fuel supplying operation to the normal operation.

Second Embodiment

Figure 7:
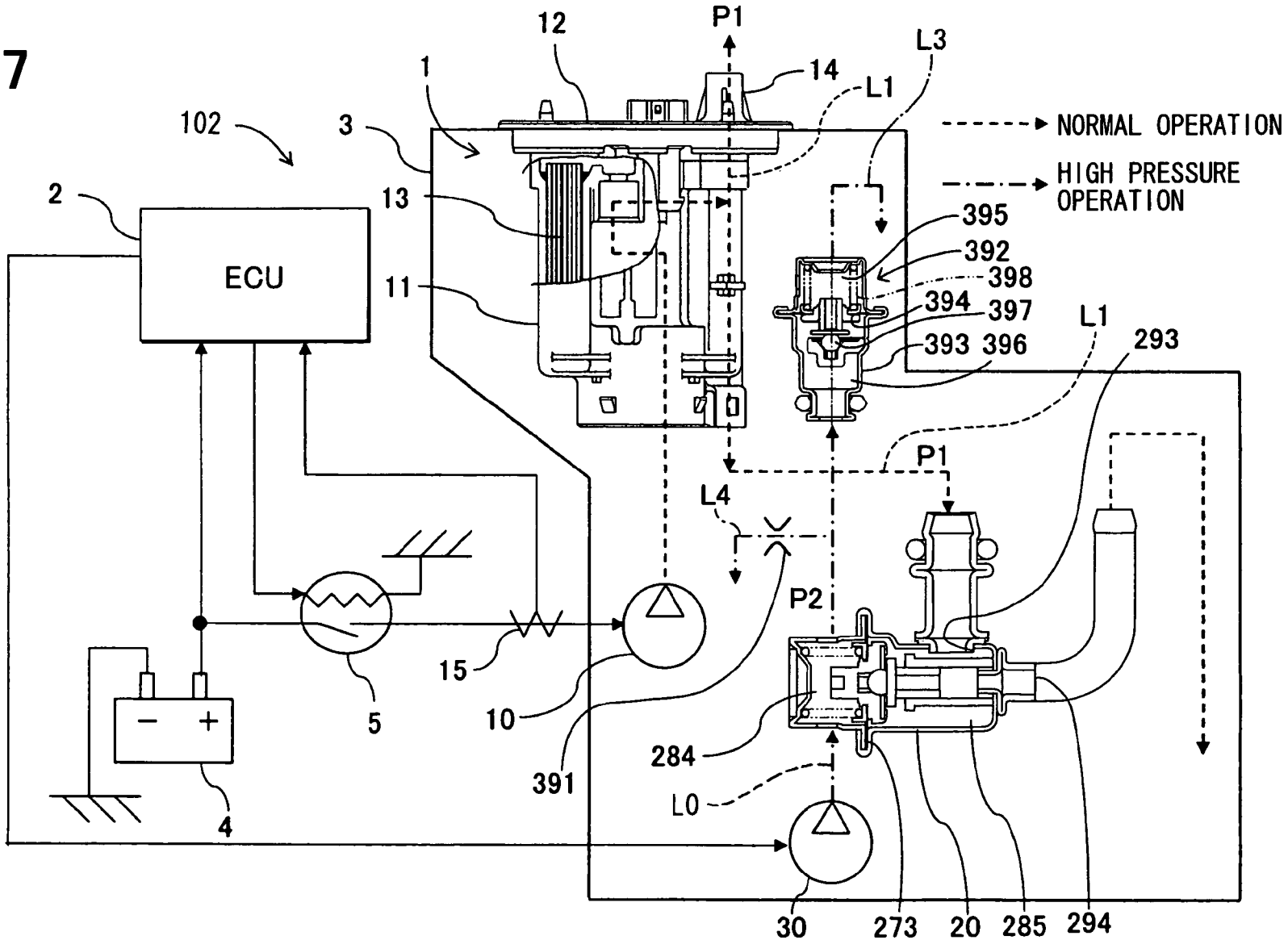
FIG. 7 is a schematic diagram showing a fuel supply system according to a second embodiment of the present invention.

In the following is described a fuel supply system 102 according to a second embodiment of the present invention, referring to FIG. 7. In the second embodiment, the same referential numerals as in the first embodiment is assigned to components substantially as same as in the first embodiment, and those components are not redundantly described. A construction of the fuel supply system 102 according to the second embodiment differs from that in the first embodiment in the following points.

The fuel supply system 102 according to the second embodiment is not provided with the secondary fuel passage L2 in the first embodiment, and does not perform the fall back operation (limp home operation) utilizing the back pressure control pump 30. Further, the communicating hole 292 formed on the back pressure side case 271 of the pressure regulator 20 is connected to a piping (not shown). As shown in FIG. 7, this piping is provided with a fuel return passage L3 that returns the excessive fuel out of the back pressure control pump 30 to the fuel tank 3.

On the fuel return passage L3 is installed a pressure regulating valve 392, which is different from the pressure regulator 20 in the first embodiment. The pressure regulating valve 392 is provided with: a case 393; a diaphragm that partitions an internal space of the case 393 into an outflow chamber 395 and an inflow chamber 396; a valve body 397 that opens and closes a communicating passage communicating the outflow chamber 395 to the inflow chamber 396; and a spring 398 that is installed in the outflow chamber 395 and biases the valve body 397 in a direction to close the communicating passage. The outflow chamber 395 is communicated to the fuel return passage L3, and the inflow chamber 396 is communicated to the back pressure chamber 284 of the pressure regulator 20.

The pressure regulating valve 392 regulates the fuel discharging pressure of the back pressure control pump 30 to a predetermined constant value. Thus, the fuel pressure in the back pressure chamber 284 is regulated to the constant value with accuracy, and the fuel discharging pressure of the primary pump 10 is adjusted with accuracy.

The piping that forms the fuel return passage L3 is connected to another piping (not shown) that has a relief passage L4. The relief passage L4 is provided with an orifice 391. Thus, when the back pressure control pump 30 stops, the fuel in the back pressure chamber 284 is discharged out of the relief passage L4, so that the fuel pressure in the back pressure chamber 284 easily decreases, to switch the high pressure fuel supplying operation (as indicated by single-dotted chain arrow line in FIG. 7) to a normal operation (as indicated by short-dashed broken arrow line in FIG. 7). Accordingly, in the fuel supply system 102 according to the present invention, which is provided with the relief passage L4, a pump having sealing function such as a gear pump can be used for the pump portion 312 of the back pressure control pump 30.

Third Embodiment

Figure 8:
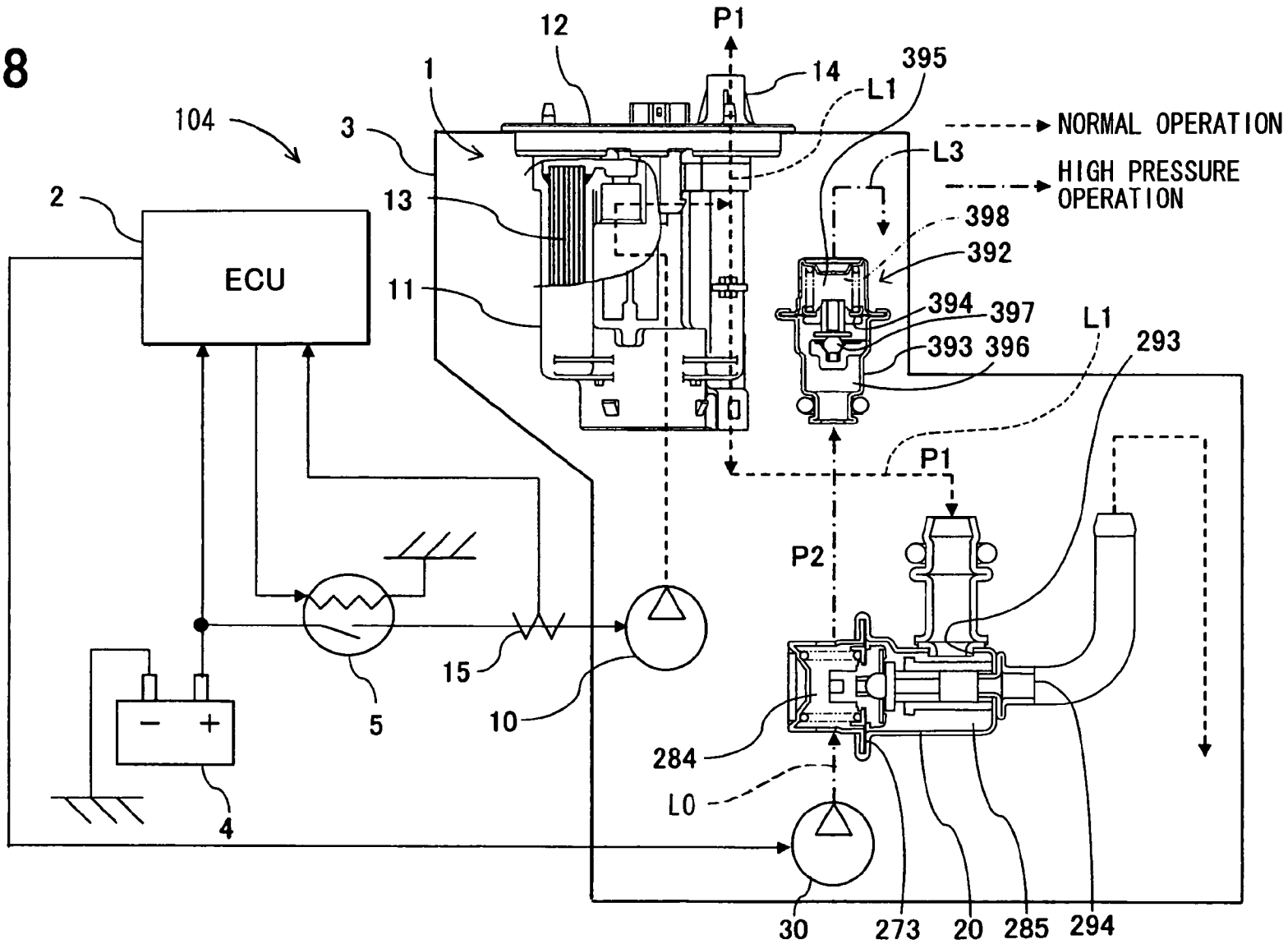
FIG. 8 is a schematic diagram showing a fuel supply system according to a third embodiment of the present invention.

In the following is described a fuel supply system 104 according to a third embodiment of the present invention, referring to FIG. 8. In the third embodiment, the same referential numerals as in the first embodiment is assigned to components substantially as same as in the first embodiment, and those components are not redundantly described. A construction of the fuel supply system 104 according to the third embodiment differs from that in the second embodiment in the following points. That is, the construction of the fuel supply system 104 according to the third embodiment is formed by eliminating the orifice 391 in the construction in the second embodiment, and a turbine pump is used for the pump portion 312 of the back pressure control pump 30 as in the first embodiment.

By using the turbine pump, when the fuel supply system 104 is switched from the high pressure fuel supplying operation (indicated by single-dotted chain arrow line in FIG. 8) to the normal operation (indicated by short-dashed arrow line), the back pressure control pump 30 stops, and the fuel in the back pressure chamber 284 flows backward in the back pressure control pump 30 and discharged through the pump passage 302 and the fuel suction port 303 into the fuel tank 3, even without the orifice 391. Accordingly, the fuel pressure in the back pressure chamber 284 easily decreases, so as to switch the fuel supply system 104 from the high pressure fuel supplying operation to the normal operation.

Fourth Embodiment

Figure 9:
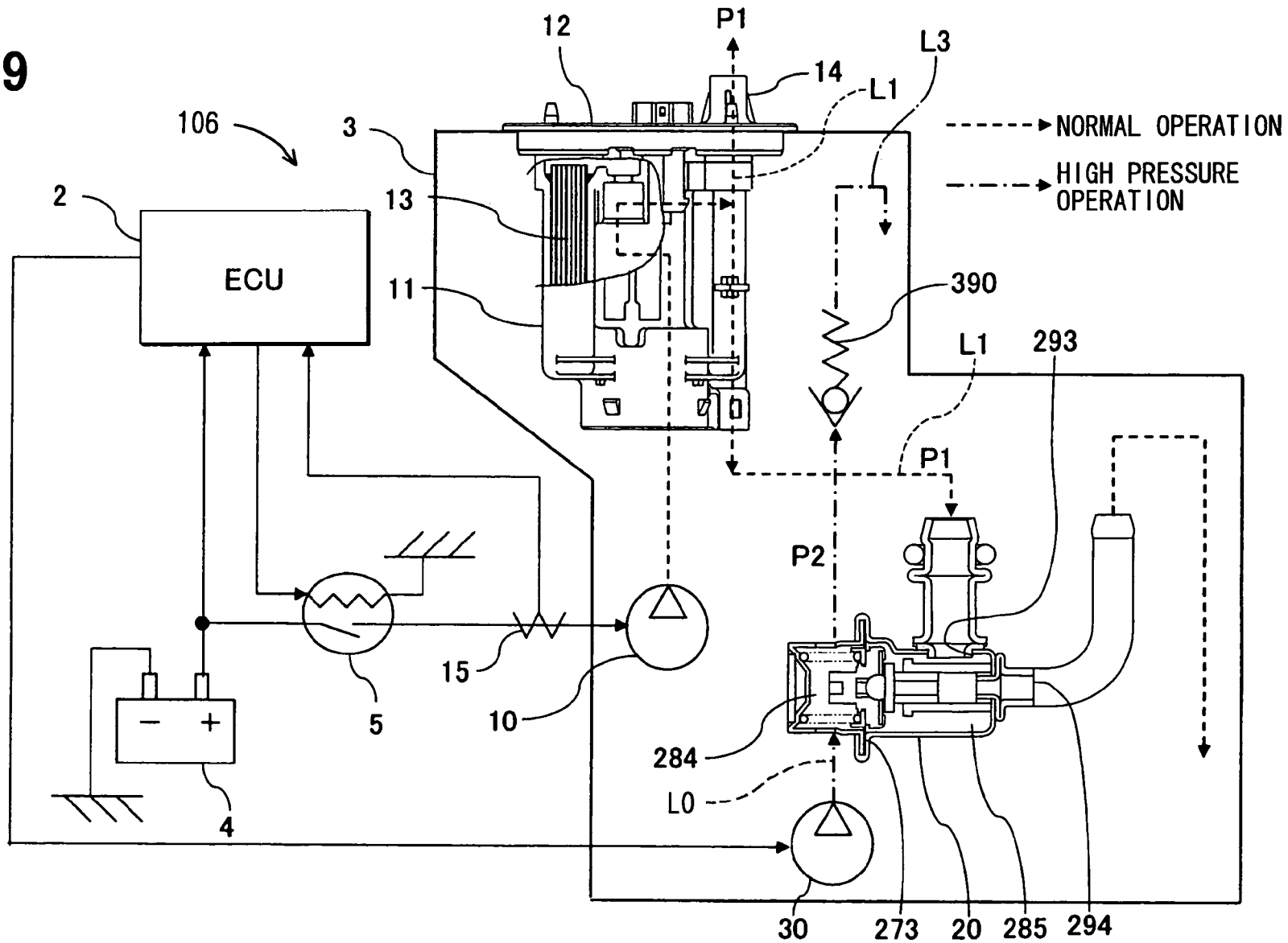
FIG. 9 is a schematic diagram showing a fuel supply system according to a fourth embodiment of the present invention.

In the following is described a fuel supply system 106 according to a third embodiment of the present invention, referring to FIGS. 9, 10. In the fourth embodiment, the same referential numerals as in the first embodiment is assigned to components substantially as same as in the first embodiment, and those components are not redundantly described. A construction of the fuel supply system 106 according to the fourth embodiment differs from that in the third embodiment in the following points. That is, the construction of the fuel supply system 106 according to the fourth embodiment is formed by substituting a check valve 390 for the pressure regulating valve 392 in the construction in the third embodiment.

Figure 10:
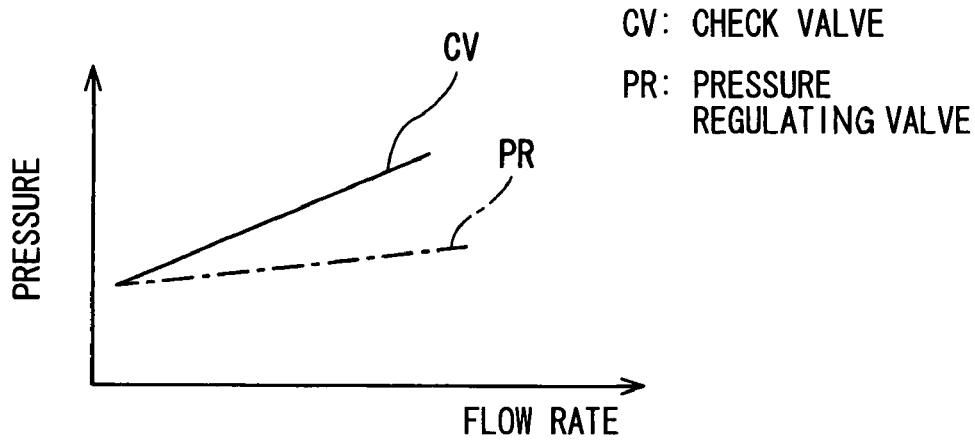
FIG. 10 is a graph showing a relationship between a fuel discharge quantity and a fuel discharging pressure of a back pressure control pump of the fuel supply system according to the fourth embodiment.

FIG. 10 illustrates a variation of the fuel discharging pressure of the back pressure control pump 30 when the fuel discharge quantity of the back pressure control pump 30 increases due to a switch from the normal operation to the high pressure fuel supplying operation. In the graph of FIG. 10, a solid line illustrates a relationship between the fuel discharge quantity and the fuel discharging pressure when the check valve 390 is used as in the fourth embodiment, and a single-dotted chain line illustrates the relationship between the fuel discharge quantity and the fuel discharging pressure when the pressure regulating valve 392 is used as in the third embodiment.

As shown in FIG. 10, the fuel discharging pressure changes steeply when the check valve 390 is used than when the pressure regulating valve 392 is used. Accordingly, when the fuel pressure in the back pressure chamber 284 is changed and the pressure P1 of the fuel discharge passage L1 of the primary pump 10 is changed, the pressure P1 is changed with smaller accuracy in the fourth embodiment than in the third embodiment. However, when it is not required to control the change of the pressure P1 of the primary pump 10, it is possible to use the check valve 390 as in the fourth embodiment, so as to reduce the manufacturing cost of the fuel supply system 106 with respect to that in the third embodiment in which the pressure regulating valve 392 is used.

Fifth Embodiment

Figure 11:
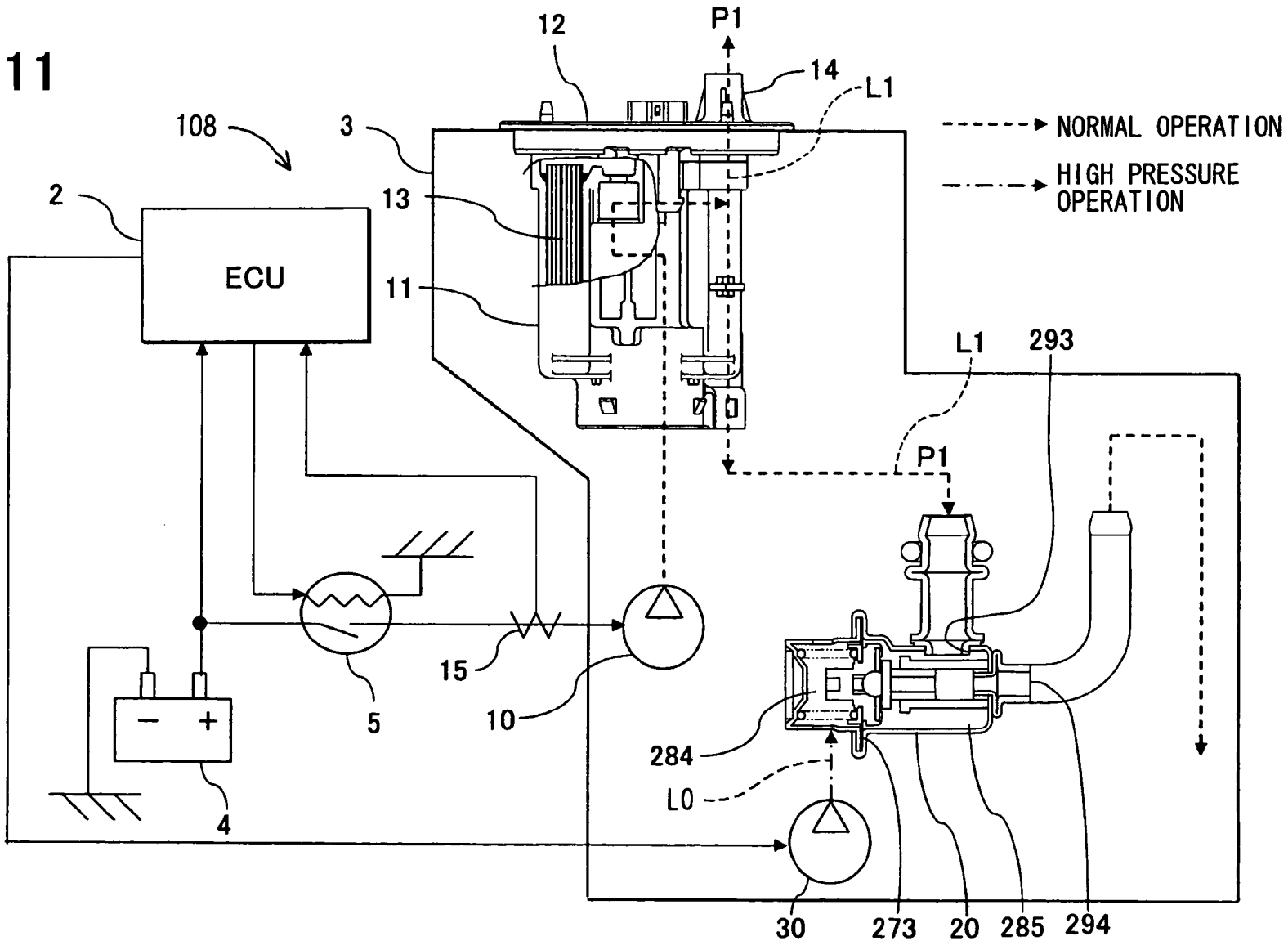
FIG. 11 is a schematic diagram showing a fuel supply system according to a fifth embodiment of the present invention.

In the following is described a fuel supply system 108 according to a fifth embodiment of the present invention, referring to FIG. 11. In the fifth embodiment, the same referential numerals as in the first embodiment is assigned to components substantially as same as in the first embodiment, and those components are not redundantly described. A construction of the fuel supply system 108 according to the fourth embodiment differs from that in the first embodiment in the following points. That is, the construction of the fuel supply system 108 according to the fourth embodiment is formed by eliminating the secondary fuel passage L2 and the check valve 390 in the first embodiment.

By changing the driving voltage (or driving current) applied to the back pressure control pump 30, the fuel discharging pressure of the back pressure control pump 30 changes, and the fuel pressure in the back pressure chamber 284 also changes. Specifically, as shown in FIG. 5, the pressure P21 on a condition that the driving voltage is 8V (or the driving current is 4V) is smaller than the pressure P22 on a condition that the driving voltage is 12V (or the driving current is 6 A). Thus, it is possible to adjust the pressure P2 of the back pressure chamber 284 by regulating the driving voltage (or the driving current). Accordingly, it is possible to eliminate the secondary fuel passage L2 and the check valve 390, so as to reduce the number of parts for forming the fuel supply system 108.

Modifications of First to Fifth Embodiments

The failure detector 15 in the first to fifth embodiments detects the driving current of the primary pump 10, and the ECU 2 determines that a failure (e.g., pump lock-up, wire breakage) of the primary pump 10 exists when the driving current is larger than or smaller than a predetermined set value. In this regard, it is also possible to calculate a rotational speed of the armature 118 based on a change of inductive electromotive force generated in the primary pump 10, and determine whether a failure of the primary pump 10 exists or not, based on a relation between a driving voltage applied to the primary pump 10 and the rotational speed of the armature 118.

Sixth Embodiment

Figure 12:
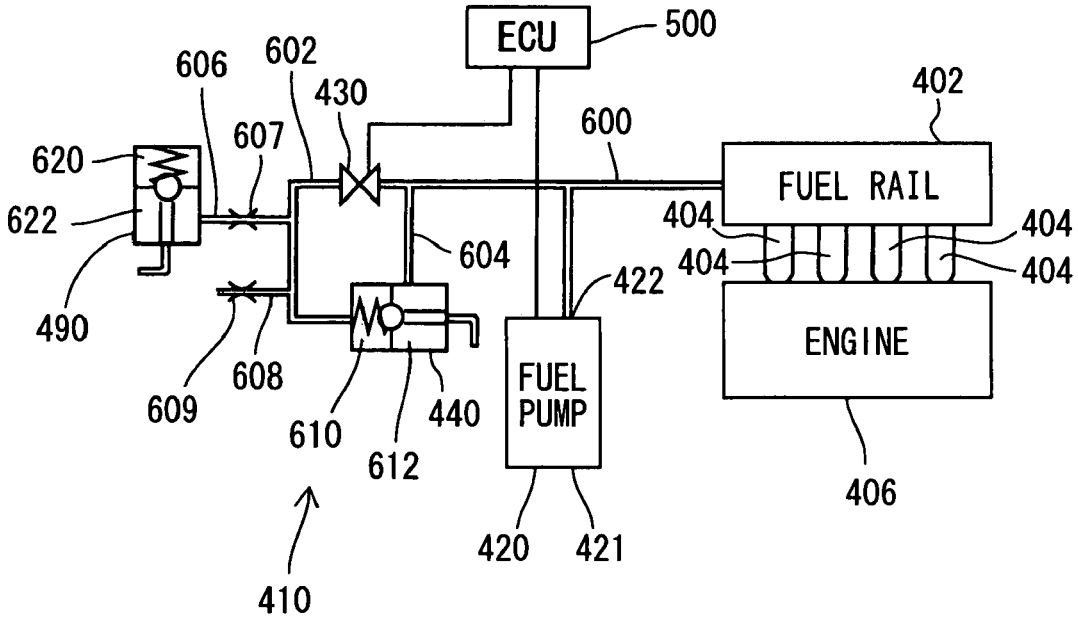
FIG. 12 is a schematic diagram showing a fuel supply system according to a sixth embodiment of the present invention.

FIG. 12 depicts a fuel supply system 410 according to a sixth embodiment of the present invention. The fuel supply system 410 supplies fuel stored in a fuel tank (not shown) to a fuel rail 402. The fuel rail 402 is communicated to fuel injection valves 404 for respective cylinders of an internal combustion engine 406.

[Construction of Fuel Supply System]

A fuel pump 420 of the fuel supply system 410 is an electrically driven turbine pump that rotates an impeller by an electrically driven motor so as to suck and pressurize the fuel. The fuel pump 420 is installed in the fuel tank (not shown).

The fuel pump 420 sucks the fuel stored in the fuel tank through a fuel suction port 421, pressurizes the fuel, and discharges the fuel out of a fuel discharge port 422. A pressure regulator 440 regulates a fuel discharging pressure of the fuel pump 420. The fuel discharged out of the fuel pump 420 flows through a piping 600 and supplied to the fuel rail 402. A construction of the pressure regulator 440 is described hereafter in detail.

The piping 600 is communicated to a back pressure chamber 610 of the pressure regulator 440 by a piping 602, which serves as a back pressure introducing passage according to the present invention. In the piping 602 is installed a shut-off valve 430, which serves as a back pressure introducing valve according to the present invention. A fuel pressure regulating chamber 612 of the pressure regulator 440 is communicated to the piping 600 by a piping 604.

The shut-off valve 430 is an electromagnetic valve. When the shut-off valve 430 is opened, the fuel discharged out of the fuel pump 420 flows through the shut-off valve 430 to piping 602, and introduced into the back pressure chamber 610 of the pressure regulator 440.

A back pressure chamber 620 of a pressure regulator 490 is opened to atmospheric air. A fuel pressure regulating chamber 622 of the pressure regulator 490 is communicated via a piping 606 to the piping 602 at a point between the shut-off valve 430 and the back pressure chamber 610. The piping 606 is provided with an orifice 607 that restricts a fuel flow quantity introduced from the piping 602 to the fuel pressure regulating chamber 622. The pressure regulator 490 regulates a fuel pressure between the shut-off valve 430 and the back pressure chamber 610 in the piping 602. Namely, the pressure regulator 490 regulates a fuel pressure in the back pressure chamber 610. The orifice 607 is installed to restrict and decrease a fuel discharge quantity out of the fuel pressure regulating chamber 622 when the pressure regulator 490 regulates the fuel pressure in the back pressure chamber 610 of the pressure regulator 440.

A fuel discharging pipe 608, which serves as a relief passage according to the present invention, is connected to the piping 602 at a point between a branch point of the piping 606 and the back pressure chamber 610. An end of the fuel discharging pipe 608, which is opposite from the other end connected to the piping 602, is opened to a space inside the fuel tank. In the fuel discharging pipe 608 is installed an orifice 609. The orifice 609 is installed to decrease a fuel discharge quantity flown through the piping 602 and discharged out of the fuel discharging pipe 608 when the shut-off valve 430 is opened to introduce the fuel discharged out of the fuel pump 420 through the piping 602 to the back pressure chamber 610 of the pressure regulator 440.

An engine control unit (ECU) 500, which serves as a fuel supply controller according to the present invention, is formed of a CPU, a ROM and a RAM (not shown). The ECU 500 turns on and off an electric power supply to the fuel pump 420 so as to control an operation of the fuel pump 420 by letting the CPU execute a control program stored in the ROM. The ECU 500 also turns on and off the electric power supply to the shut-off valve 430 so as to open and close the shut-off valve 430 in accordance with driving states of the internal combustion engine 406.

[Pressure Regulator]

Figure 13:
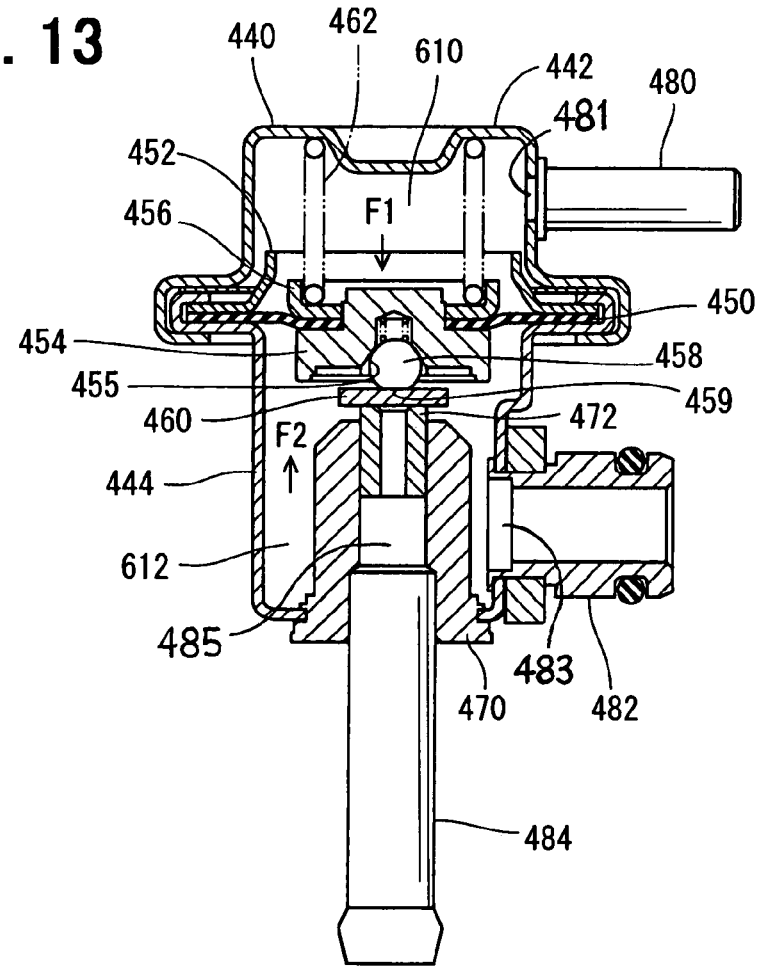
FIG. 13 is a cross-sectional view showing a pressure regulator of the fuel supply system according to the sixth embodiment.

A construction of the above-mentioned pressure regulator 440 is described in detail in the following, referring to FIG. 13. A pressure regulation side case 444 of the pressure regulator 440 is swaged to a back pressure side case 442. An outer circumferential portion of a diaphragm 450 and a pinching member 452 are tightly swaged to the pressure regulation side case 444. An inner circumferential portion the diaphragm 450 is tightly sandwiched between a valve guide 454 and a spring seat 456. A ball 458 is fitted to a depressed portion 455 of the valve guide 454. The ball 458 has a flat surface 459 on an opposite side from a portion fitted to the depressed portion 455. The flat surface 459 is in contact with a disk-like shaped valve head member 460. A cylindrical support member 470 is fixed to the pressure regulation side case 444. A cylindrical valve seat member 472 is fixed to an inner wall of the support member 470 so as to protrude toward the valve head member 460. A spring (elastic member) 462 is installed in a spring chamber served by the back pressure chamber 610. The spring 462 applies a biasing force to the diaphragm 450, the valve guide 454, the spring seat 456, the ball 458 and the valve head member 460 in a direction toward the valve seat member 472.

A connection pipe 480 communicates the back pressure chamber 610 in the back pressure side case 442 to the piping 602. The fuel in the piping 602 flows through the connection pipe 480, and is introduced into the back pressure chamber 610. A connection pipe 482 communicates the fuel pressure regulating chamber 612 in the pressure regulation side case 444 to the piping 604. The fuel in the piping 600 flows through the piping 604 and the connection pipe 482, and is introduced into the fuel pressure regulating chamber 612. A relief pipe 484 is fixed to an inside of the support member 470 on a side opposite from the valve seat member 472. When the valve head member 460 is lifted apart from the valve seat member 472, the fuel in the fuel pressure regulating chamber 612 is discharged out of the relief pipe 484 into the fuel tank.

[Starting Time and Normally Operating Time of Internal Combustion Engine]

In the following is described an operation of the fuel supply system 410. The ECU 500 sets a fuel injection pressure of the fuel injection valves 404 to a high pressure or to a low pressure, in accordance with the driving states of the internal combustion engine 406, which is detected by sensors (not shown). In a starting time of the internal combustion engine 406, for example, it is desirable to set the pressure of the fuel, which is supplied to the fuel injection valves 404, to the high pressure. This is to promote atomization of sprayed fuel in low temperature condition, and also to promote the atomization of the sprayed fuel and to suppress vapor generation in the fuel in high temperature condition. When a load applied to the internal combustion engine is relatively small during a constant-speed driving time of vehicle, for example, the pressure of the fuel supplied to the fuel injection valves 404 can be set to the low pressure. The pressure of the fuel supplied to the fuel injection valves 404 is switched to the high pressure or to the low pressure by opening and closing operation of the shut-off valve 430 controlled by the ECU 500.

Figure 14:
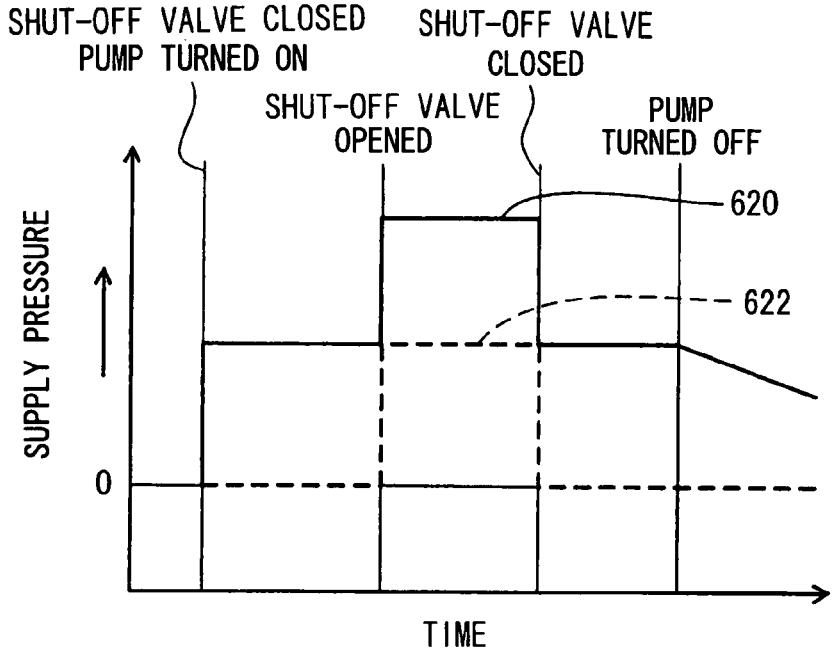
FIG. 14 is a graph showing a fuel supply pressure characteristic of the fuel supply system according to the sixth embodiment, in accordance with an operation of a fuel pump and an opening/closing state of a back pressure introducing valve of the fuel supply system according to the sixth embodiment.

(1) When the fuel pump 420 is started on a condition that an electric power supply to the shut-off valve 430 is turned off and the shut-off valve 430 is closed, for example, the pressure of the fuel, which is supplied through the piping 600 to the fuel rail 402, increases as indicated by a solid line 620 in FIG. 14. A dashed line in FIG. 14 indicates a fuel pressure variation in the piping 602 corresponding to an opening and closing operation of the shut-off valve 430. When the shut-off valve 430 is closed, the piping 602 is blocked and the fuel discharged out of the fuel pump 420 is not introduced into the back pressure chamber 610 of the pressure regulator 440. The piping 602 is opened to the atmospheric air via the fuel discharging pipe 608, so that the pressure in the back pressure chamber 610 is approximately equal to the pressure of the atmospheric air. The piping 600, 604 introduce the fuel discharged out of the fuel pump 420 to the fuel pressure regulating chamber 612 of the pressure regulator 440.

Thus, the diaphragm 450 is displaced (bulged) in accordance with a difference between a force F1, which acts onto the diaphragm 450 in a direction to seat the valve head member 460 on the valve seat member 472, and a force F2, which acts onto the diaphragm 450 in a direction to lift the valve head member 460 apart from the valve seat member 472. The force F1 is a resultant of a force applied by the pressure of the fuel in the back pressure chamber 610, which corresponds to the atmospheric pressure, and a biasing force of the spring 462. The force F2 is applied by the pressure of the fuel discharged out of the fuel pump 420 and introduced into the fuel pressure regulating chamber 612.

When the force F1 is equal to or larger than the force F2, the valve head member 460 is seated on the valve seat member 472, and the fuel in the fuel pressure regulating chamber 612 is not discharged out of the discharge pipe 484. When the pressure in the fuel pressure regulating chamber 612 rises and the force F1 becomes smaller than the force F2, the valve head member 460 is lifted apart from the valve seat member 472, and the fuel in the fuel pressure regulating chamber 612 is discharged out of the discharge pipe 484. Then, the pressure of the fuel in the fuel pressure regulating chamber 612, i.e., the pressure of the fuel, which is discharged out of the fuel pump 420 and supplied through the piping 600 to the fuel rail 402, decreases.

(2) Next, as shown in FIG. 14, when the electric power supply to the shut-off valve 430 is started to open the shut-off valve 430 on a condition that the fuel pump 420 is driving, the fuel discharged out of the fuel pump 420 is introduced not only to the fuel pressure regulating chamber 612 but also to the back pressure chamber 610 of the pressure regulator 440 through the piping 602. In this time, the pressure of the fuel introduced in the back pressure chamber 610 is set to a pressure larger than the atmospheric pressure by the pressure regulator 490. Thus, the force F1 becomes smaller than the force F2, and the diaphragm 450 is displaced (bulged) against the pressure applied by the fuel pressure in the back pressure chamber 610. Then, the fuel pressure in the fuel pressure regulating chamber 612 when the valve head member 460 is lifted apart from the valve seat member 472 becomes larger than the fuel pressure when the shut-off valve 430 is opened and the fuel discharged out of the fuel pump 420 is not introduced into the back pressure chamber 610. That is, the set pressure of the pressure regulator 440 is raised. As a result, as shown in FIG. 14, when the shut-off valve 430 is opened, the fuel pressure in the fuel pressure regulating chamber 612, i.e., the pressure of the fuel that is discharged out of 420 and supplied through the piping 600 to the fuel rail 402 is larger than that when the shut-off valve 430 is closed.

(3) When the shut-off valve 430 is switched from opening state to closing state, the fuel discharged out of the fuel pump 420 stops being introduced into the back pressure chamber 610. Then, the fuel in the piping 602 is discharged out of the fuel discharging pipe 608, and the pressure in the back pressure chamber 610 decreases approximately to the atmospheric pressure. As a result, the set pressure of the pressure regulator 440 is decreased, and the fuel discharging pressure of the fuel pump 420 is set to the low pressure. Accordingly, the pressure of the fuel, which is supplied from the fuel pump 420 to the fuel rail 402, decreases.

In this manner, the ECU 500 controls the opening and closing operations of the shut-off valve 430 in accordance with the driving states of the internal combustion engine 406, so as to switch the pressure of the fuel supplied to the fuel rail 402 between the high pressure and the low pressure.

[Stopping Time of Internal Combustion Engine]

Figure 15:
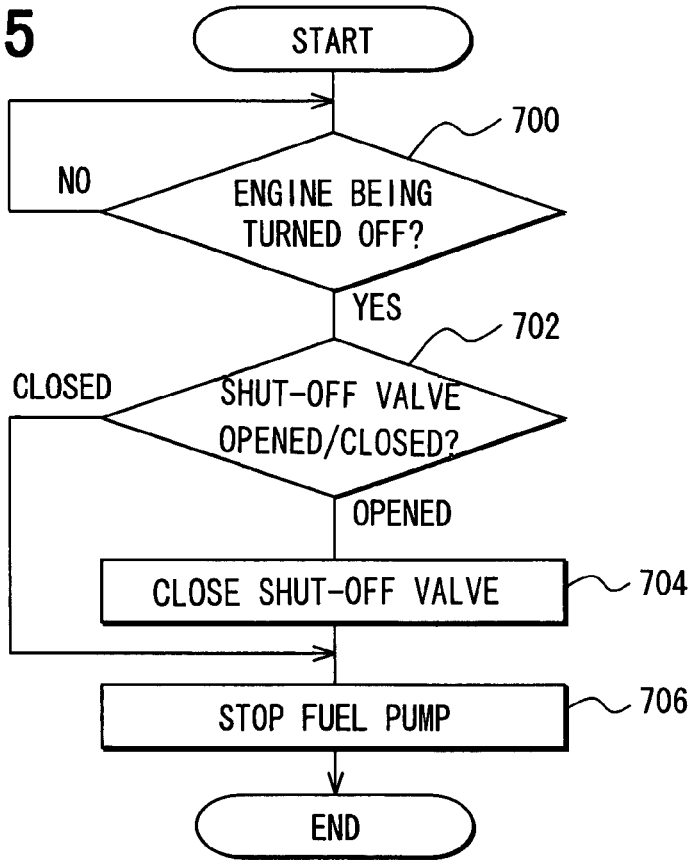
FIG. 15 is a flow chart showing a control procedure of the fuel pump and the back pressure introducing valve of the fuel supply system according to the sixth embodiment, when an internal combustion engine is stopping.

In the following is described an operation of the fuel supply system when the internal combustion engine 406 is stopping, referring to a flow chart shown in FIG. 15.

The ECU 500 determines whether the internal combustion engine 406 is stopping or not, in a step 700. If the internal combustion engine 406 is stopping, the ECU 500 determines whether the shut-off valve 430 is opened or closed in a step 702. If the shut-off valve 430 is closed, the ECU 500 stops the electric power supply to the fuel pump 420 to stop the fuel pump 420 in a step 706. When the fuel supply sump 420 is stopped while the shut-off valve 430 is closed as mentioned above, the piping 600 is blocked by the shut-off valve 430 and a check valve (not shown) that is installed in and in the fuel discharge port 422 of the fuel pump 420, so as to prevent the fuel from leaking from the piping 600 and the fuel rail 402. Accordingly, a decrease of a residual pressure in the piping 600 and in the fuel rail 402 is limited, to improve a startability of the internal combustion engine 406. Further, by limiting the decrease of the residual pressure in the piping 600 and in the fuel rail 402, it is possible to suppress the vapor generation in the piping 600 and in the fuel rail 402 especially when the internal combustion engine 406 is stopped on a condition that the fuel temperature is relatively high. Accordingly, the startability of the internal combustion engine 406 is further improved.

If the ECU 500 determines that the shut-off valve 430 is opening in the step 702, the ECU 500 stops the electric power supply to the shut-off valve 430 to open the shut-off valve 430, in a step 704. After opening the shut-off valve 430, the ECU 500 stops the electric power supply to the fuel pump 420 to stop the fuel pump 420 in the step 706.

When the fuel pump 420 is stopped on a condition that the shut-off valve 430 is opening, the fuel in the piping 600 is discharged through the piping 602 and the fuel discharging pipe 608 in a period from the stop of the fuel pump 420 and a valve open of the shut-off valve 430, and the fuel pressure in the piping 600 and in the fuel rail 402 can decrease.

In this regard, it is possible to stop the fuel pump 420 to maintain the fuel pressure in the piping 600 and in the fuel rail 402, by stopping the fuel pump 420 after closing the shut-off valve 430 if the shut-off valve 430 is opened. Thus, the fuel supply system 410 limits a decrease of the residual pressure in the piping 600 and in the fuel rail 402, and suppresses the vapor generation in the piping 600 and in the fuel rail 402, so as to improve the startability of the internal combustion engine 406.

In the above-described fuel supply system 410 according to the sixth embodiment, the set pressure of the pressure regulator 440 is increased without raising the biasing force of the spring 462, by introducing the fuel discharged out of the fuel pump 420 into the back pressure chamber 610 of the pressure regulator 440 for regulating the fuel discharging pressure of the fuel pump 420. Accordingly, it is possible to raise the fuel discharging pressure of the fuel pump 420 without upsizing the spring 462 and the pressure regulator 440.

When the fuel is introduced into the back pressure chamber 610 in order to raise the set pressure of the pressure regulator 440, the fuel discharge quantity of the fuel pump 420 is stable relative to a quantity of the excessive fuel of the internal combustion engine 406, for example. Accordingly, the pressure regulator 440 can regulate the fuel discharging pressure of the fuel pump 420 stably to reduce a fluctuation in the fuel discharging pressure.

Further, the fuel pressure introduced into the back pressure chamber 610 of the pressure regulator 440 is adjusted by another pressure regulator 490. Thus, it is possible to change the pressure of the fuel introduced into the back pressure chamber 610 of the pressure regulator 440, by changing the set pressure of the pressure regulator 490 by adjusting a biasing force of the spring in the pressure regulator 490. That is, the set pressure of the pressure regulator 440 is adjusted by changing the set pressure of the pressure regulator 490, so that it is possible to change the fuel discharging pressure of the fuel pump 429, which is regulated by the pressure regulator 440.

Seventh Embodiment

Figure 16:
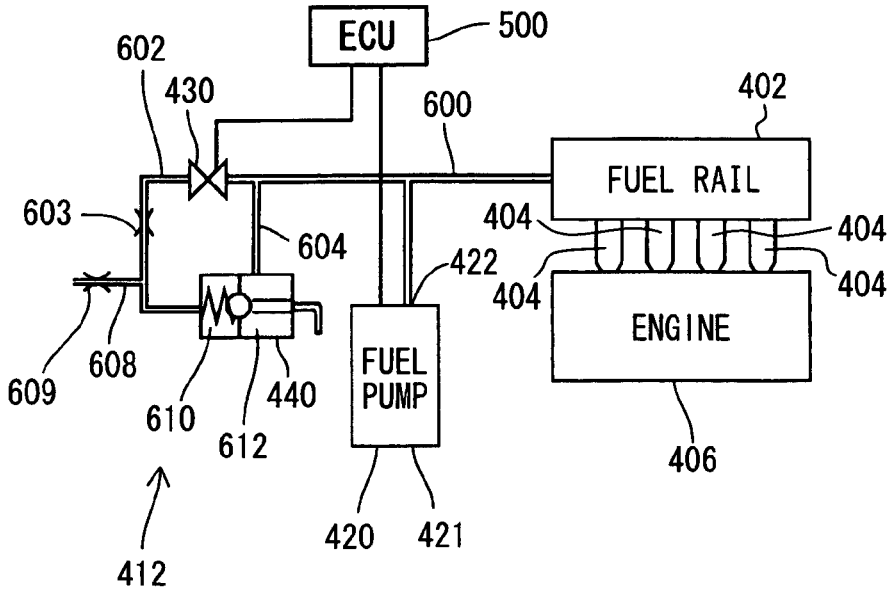
FIG. 16 is a schematic diagram showing a fuel supply system according to a seventh embodiment of the present invention.

FIG. 16 schematically depicts a fuel supply system 412 according to a seventh embodiment of the present invention. In the seventh embodiment, the same referential numerals as in the sixth embodiment is assigned to components substantially as same as in the sixth embodiment, and those components are not redundantly described.

In the fuel supply system 412 shown in FIG. 16, the pressure of the fuel introduced into the back pressure chamber 610 of the pressure regulator 440 is regulated not by the pressure regulator 490 as in the sixth embodiment, but by an orifice 603 that is provided in the piping 602. By adjusting an opening diameter of the orifice 203, it is possible to adjust the pressure of the fuel that is introduced into the back pressure chamber 610 of the pressure regulator 440.

Eighth Embodiment

Figure 17:
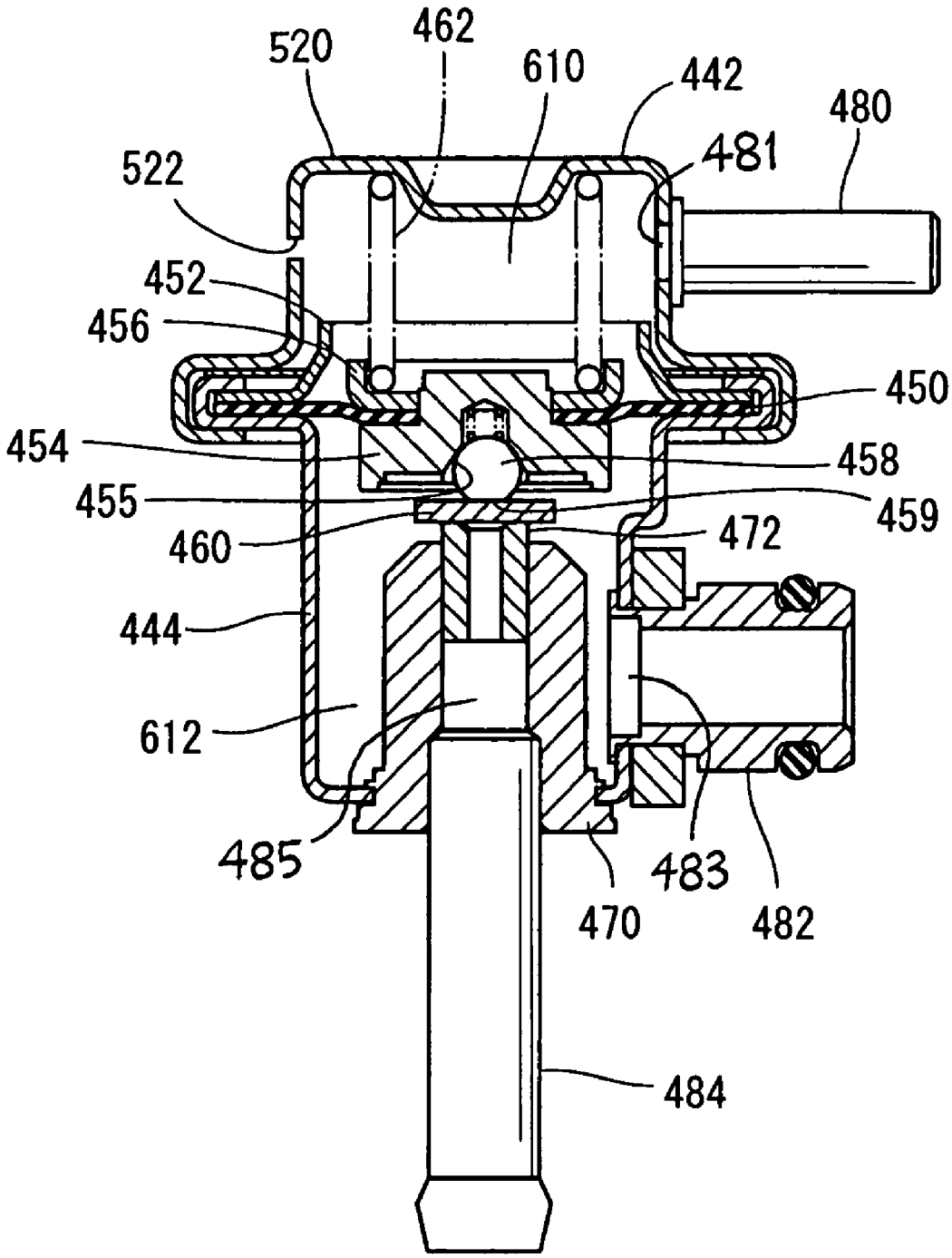
FIG. 17 is a cross-sectional view showing a pressure regulator of a fuel supply system according to an eighth embodiment of the present invention.

FIG. 17 depicts a pressure regulator 520 of a fuel supply system according to an eighth embodiment of the present invention. In the eighth embodiment, the same referential numerals as in the sixth embodiment is assigned to components substantially as same as in the sixth embodiment, and those components are not redundantly described.

The fuel supply system according to the eighth embodiment is provided with the pressure regulator 520 instead of the pressure regulator 440 in the sixth embodiment. An orifice 522 is formed on a back pressure side case 442 of the pressure regulator 520. The orifice 522 acts in the same manner as the orifice 609 installed in the piping 602 of the fuel supply system 410 according to the sixth embodiment. Thus, the fuel supply system according to the eighth embodiment is not provided with the fuel discharging pipe 608 and the orifice 609, which are provided in the fuel supply system 410 according to the sixth embodiment shown in FIG. 12.

As described above, in the fuel supply system according to the eighth embodiment, the orifice 522, which releases the pressure in the back pressure chamber 610 of the pressure regulator 520 to an atmospheric air when the shut-off valve 430 is closed, is provided in the pressure regulator 520. Thus, a construction of piping of the fuel supply system is simplified. Further, when the shut-off valve 430 is opened, the back pressure chamber 610 of the pressure regulator 520 is regularly provided with fuel, so that the fuel does not stagnate in the back pressure chamber 610. Thus, it is possible to prevent parts that are exposed to a space in the back pressure chamber 610 from corrosion.

Modifications of the Sixth to Eighth Embodiments

In the sixth to eighth embodiments, the pressure of the fuel introduced into the back pressure chamber 610 of the pressure regulator 440, 520 is regulated by the pressure regulator 490 or by the orifice 603. However, it is also possible to introduce the fuel discharged out of the fuel pump 420 directly into the pressure regulator 440, 520 neither via the pressure regulator 490 nor via the orifice 603.

In the sixth to eighth embodiments, the shut-off valve 430 opens and closes the piping 602 to switch the set pressure of the pressure regulator 440, 520 to the high pressure or to the low pressure. However, it is possible to specify the set pressure of the pressure regulator 440, 520 regularly to the high pressure, without installing the shut-off valve 430 in the piping 602.

In the sixth to eighth embodiments, when the shut-off valve 430 is closed from a state in which the shut-off valve 430 is opened, the fuel in the back pressure chamber 610 is discharged through the orifice 609 installed in the fuel discharging pipe 608 or through the orifice 522 provided in the pressure regulator 520, to release the pressure in the back pressure chamber 610 of the pressure regulator 440, 520 to the atmospheric air. In this regard, it is also possible to decrease the pressure in the back pressure chamber 610 by gradually releasing the fuel from the back pressure chamber without using the fuel discharging pipe 608 nor using the orifice 522.

In the fuel supply system in which the set pressure of the pressure regulator 440, 520 is changed by opening and closing the shut-off valve 430 as described in the above sixth to eighth embodiments, it is desirable to detect faulty in pressure regulation based on an electric signal sent by a fuel pressure sensor and/or the driving current applied to the fuel pump 420 and notify the faulty to a driver of vehicle when the fuel discharging pressure of the fuel pump 420 cannot be regulated to a target pressure due to failures of parts and the like.

This description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel supply system for supplying fuel from a fuel tank to a fuel supply piping, the system comprising:

a back pressure introducing passage provided with a pressure regulating orifice;

a fuel pump that supplies the fuel from the fuel tank to the fuel supply piping and to the back pressure introducing passage; and a pressure regulator provided with a case, a diaphragm that partitions an inner space of the case into a fuel pressure regulating chamber and a back pressure chamber, a fuel pressure regulating port that communicates the fuel pressure regulating chamber to the fuel supply piping, a back pressure introducing port that communicates the back pressure chamber to the back pressure introducing passage, a relief port that communicates the fuel pressure regulating chamber to the fuel tank, and a relief valve that operates in accordance with a bulging degree of the diaphragm so as to open the relief port when a fuel pressure in the fuel pressure regulating chamber is larger than a relief pressure that bulges the diaphragm toward the fuel pressure regulating chamber and to close the relief port when the fuel pressure in the fuel pressure regulating chamber is not larger than the relief pressure, wherein the relief pressure is adjusted by controlling a fuel pressure in the back pressure chamber of the pressure regulator, and wherein the back pressure introducing passage is communicated with the fuel supply piping, and further comprising a back pressure introducing valve that allows and interrupts a communication between the back pressure introducing passage and the fuel supply piping.

2. A fuel supply system for supplying fuel from a fuel tank to a fuel supply piping, the system comprising:

a back pressure introducing passage;

a fuel pump that supplies the fuel from the fuel tank to the fuel supply piping and to the back pressure introducing passage; and a pressure regulator provided with a case, a diaphragm that partitions an inner space of the case into a fuel presure regulating chamber and a back pressure chamber, a fuel pressure regulating port that communicates the fuel pressure regulating chamber to the fuel supply piping, a back pressure introducing port that communicates the back pressure chamber to the back pressure introducing passage, a relief port that communicates the fuel pressure regulating chamber to the fuel tank, and a relief valve that operates in accordance with a bulging degree of the diaphragm so as to open the relief port when a fuel pressure in the fuel pressure regulating chamber is larger than a relief pressure that bulges the diaphragm toward the fuel pressure in the fuel pressure regulating chamber is not larger than the relief pressure, wherein the relief pressure is adjusted by controlling a fuel pressure in the back pressure chamber of the pressure regulator, and wherein the fuel pump includes:

a primary pump that supplies the fuel from the fuel tank exclusively to the fuel supply piping; and a back pressure control pump that supplies the fuel from the fuel tank exclusively to the back pressure introducing passage.

3. The fuel supply system according to claim 2, wherein the back pressure control pump is a centrifugal pump.

4. The fuel supply system according to claim 2, further comprising a back pressure controller that controls the fuel pressure in the back pressure chamber of the pressure regulator.

5. The fuel supply system according to claim 4, wherein the back pressure controller is a back pressure pump controller that controls a fuel discharging pressure of the back pressure control pump.

6. The fuel supply system according to claim 4, wherein the back pressure controller is a pressure regulating valve that regulates the fuel pressure in the back pressure chamber of the pressure regulator.

7. The fuel supply system according to claim 2, further comprising a return passage that returns an excessive part of the fuel, which is excessively supplied by the back pressure control pump into the back pressure chamber, to the fuel tank.

8. The fuel supply system according to claim 2, further comprising a secondary passage that communicates the back pressure chamber of the pressure regulator to the fuel supply piping.

9. The fuel supply system according to claim 8, further comprising a secondary passage shutting valve that is installed in the secondary passage and opens the secondary passage when the fuel pressure in fuel pressure regulating chamber of the pressure regulator is smaller than a predetermined value.

10. The fuel supply system according to claim 9, wherein the secondary passage shutting valve is a check valve that restricts a fuel flow in the secondary passage to a direction from the back pressure chamber of the pressure regulator to the fuel supply piping and opens the secondary passage when a difference between the fuel pressure in the fuel pressure regulating chamber and the fuel pressure in the back pressure chamber of the pressure regulator is larger than a predetermined value.

11. The fuel supply system according to claim 2, further comprising:

a relief passage that communicates the back pressure chamber of the pressure regulator to the fuel tank; and an orifice that is installed in the relief passage.

12. The fuel supply system according to claim 1, further comprising a relief passage that communicates the back pressure introducing passage to the fuel tank; and an orifice that is installed in the relief passage.

13. The fuel supply system according to claim 1, further comprising a fuel supply controller that controls an operation of the fuel pump and an operation of the back pressure introducing valve, wherein the fuel supply controller closes the back pressure introducing valve always before the fuel supply controller stops the fuel pump.

* * * * *